United States Patent [19]

Koskol et al.

[11] Patent Number: 4,863,029

[45] Date of Patent: Sep. 5, 1989

[54] APPARATUS AND PROCESS FOR PACKAGING YARN AND PRODUCT THEREFROM

[75] Inventors: Joseph E. Koskol, Wilmington, Del.; Robert J. Santucci, West Chester, Pa.; Louis G. Rosanio, Jr., Wilmington, Del.

[73] Assignee: E. I. Du Pont de Nemours and Company, Wilmington, Del.

[21] Appl. No.: 121,059

[22] Filed: Nov. 16, 1987

[51] Int. Cl.[4] ..... B65D 85/00

[52] U.S. Cl. ..... 206/393; 206/388; 206/392; 28/289; 242/166; 242/167

[58] Field of Search ..... 206/388, 391, 392, 393; 28/289; 19/160; 242/159, 166, 167

[56] References Cited

U.S. PATENT DOCUMENTS

| | | | |
|---|---|---|---|
| 29,774 | 9/1978 | Vidal et al. | 428/400 |
| 710,937 | 10/1902 | Baker | 242/167 |
| 1,878,306 | 9/1932 | Whittier | 206/393 |
| 2,080,185 | 5/1937 | Rathgeber | 28/289 |
| 2,678,724 | 5/1954 | Andriot Jr. | 206/393 |
| 2,780,838 | 2/1957 | Wilkie | 19/66 |
| 2,834,092 | 5/1958 | Drummond et al. | 28/289 |
| 2,936,508 | 5/1960 | Buddecke | 206/393 |
| 3,036,357 | 3/1959 | Cook et al. | 28/1 |
| 3,049,230 | 8/1962 | Van Scoy | 206/393 |
| 3,061,088 | 10/1962 | Buddecke | 242/167 |
| 3,109,540 | 11/1963 | Klimpl | 206/393 |
| 3,281,913 | 8/1964 | Morehead et al. | 28/21 |
| 3,341,911 | 9/1967 | Smith | 28/1 |
| 3,403,311 | 7/1946 | Steele | 28/289 |
| 3,410,394 | 11/1968 | Jackson et al. | 206/393 |
| 3,413,185 | 9/1964 | Davis et al. | 161/169 |
| 3,478,399 | 11/1969 | Wyatt et al. | 28/289 |
| 3,780,405 | 12/1973 | Izawa et al. | 28/1.6 |
| 3,859,695 | 1/1975 | Erickson | 28/1.7 |
| 3,935,622 | 2/1976 | Crotti | 28/289 |
| 3,968,877 | 7/1976 | Mattis | 28/289 |
| 3,980,176 | 9/1976 | Boggs | 206/392 |
| 3,983,610 | 10/1976 | Eskridge et al. | 28/1.6 |
| 3,983,997 | 10/1976 | Warshaw | 206/392 |
| 4,175,157 | 11/1979 | Guillermin et al. | 428/369 |
| 4,180,214 | 12/1979 | Li et al. | 242/47 |
| 4,334,654 | 6/1982 | Warren et al. | 242/147 R |

FOREIGN PATENT DOCUMENTS

| | | |
|---|---|---|
| 127842 | 10/1977 | German Democratic Rep. . |
| 145549 | 12/1980 | German Democratic Rep. . |

OTHER PUBLICATIONS

Systematic Methods for Yarn Storage in Geometric Patterns, W. Oswald and H. Vieth; Textiltechnik 28, No. 12:741–744 (1978).

Proposals for Yarn Accumulation with a Simultaneous Increase in Yarn Speed, W. Oswald and H. Vieth; Wiss. Z. Tech. Hochsch. Karl Marx Stadt 23, No. 2:103–111 (1981).

*Primary Examiner*—David T. Fidei

[57] ABSTRACT

A layered yarn package is formed of continuous filament yarn wads wherein the yarn alternates between compacted and extended lengths by axially compacting the yarn into a length, segmenting the length into alternating extended and compacted lengths then arranging the compacted lengths in a common axial direction one next to the other to form a layer. The layer may be compressed. One or more layers may form the package.

10 Claims, 17 Drawing Sheets

APPARATUS AND PROCESS FOR PACKAGING YARN AND PRODUCT THEREFROM

BACKGROUND OF THE INVENTION

This invention relates to a process for packaging yarn into a layered package and more particularly it relates to a process for forming continuous filament yarn into a compact wad then segmenting the wad into a die-by-side arrangement wherein the yarn alternates between compacted and extended lengths.

Increasing operating speeds in synthetic fiber production make high demands on packaging systems for continuous filament yarn. High speed winders which take up the yarn in cross wound cylindrical packages are relatively expensive and are limited in the size of package that can be made. In addition, these high speed winders are extremely noisy.

Accumulating continuous filament yarn in plug form is known in the prior art as well as various methods for collecting the plugs or wads into a package. The wad forming processes, while somewhat satisfactory for the purpose intended, require bulk processing to produce high density packages which can result in nonuniform wad properties within a package.

SUMMARY OF THE INVENTION

The present invention is particularly advantageous when compared to prior art techniques in that the package is formed from individual separable layers which can be independently handled continuously. This permits one layer to be further processed, such as by compressing to a higher density, while the next layer is being formed. The individual compacted layers remain connected by extended lengths of yarn to result in a package of continuous yarn that can be built up directly in a shipping container.

The process comprises introducing the yarn to be packaged into one end of an elongated confined space by means of a pressurized fluid then contacting the yarn with heated fluid to relax the yarn and tightly packing the yarn axially on itself in the confined space by releasing the pressurized fluid at a controlled rate from the confined space. The yarn thus packed is forced out through the space by the remaining pressurized fluid in the form of a wad. The wad speed exiting the confined space is controlled by a pair of endless driven belts. In a preferred embodiment the wad is separated into distinct segments of alternating extended and axially compacted lengths with the compacted lengths having a common axial direction. The compacted lengths are arranged in a layer, preferably one next to the other in the same axial direction, with the extended lengths connecting the compacted lengths. The layers have major planar surfaces that are opposed to each other, such as a top and bottom. Each of the layers is formed with these surfaces facing in a common direction, that is all layers having a common direction vector. The layers are heated and compressed and then stacked one next to the other with an opposed surface of one layer in contact with an opposed surface of the next layer, and preferably with all layers facing the same direction to form a package. The layers are connected one to the other by extended yarn lengths that serve to permit separation of the layers for independent processing. One layer can be stacked while another is being compressed, while another is being formed. This simultaneous, sequential handling of layers, that remain as a continuous yarn by the connecting of extended lengths, is preferably a continuous process.

This requirement for individual handling of layers defines a minimum length for the extended length between layers, which is a characteristic feature of this invention. It is the length long enough to connect two layers in a side-by-side relationship in the same plane and also to connect these two layers stacked one next to the other with opposing surfaces in contact and with both layers facing the same direction. For different layer arrangements, this length may be different, but it is generally as long as the minor axis of the planar arrangement of wads. For a curvilinear arrangement such as a circular or spiral planar array of compacted wads, this minimum length would be the diameter; for a straight arrangement such as a serpentine or zigzag array of compacted wads, the minimum length would be the shorter planar axis of the array.

The preferred package is formed of layers of yarn wads with each layer segmented into alternating extended and axially compacted lengths arranged one next to the other with their axial direction the same. The laydown pattern is horizontally in a zigzag form wherein compacted yarn lengths next to each other are connected front one end of one compacted length to the opposite end of the next by an extended yarn length. Layers are successively connected one to the next by an extended length of yarn and the connected layers may have their compacted length directions aligned or at right angles to each other.

For practicing the above-described process, an apparatus especially effective for tightly packing the yarn into a wad while avoiding excessive entanglements occurring in the longitudinal direction of the wad is provided. This wad forming apparatus comprises means for using pressurized fluid for forwarding and compacting yarn in a chamber which has an entrance and an exit. Excess fluid is released from the chamber through a vent located adjacent to the entrance of the chamber. Yarn is delivered into the chamber through a tube, coextensive with the yarn path, that extends from the entrance to the chamber to a location below the location of the vent.

DETAILED DESCRIPTION OF THE PREFERRED EMBODIMENT

Figure 1:
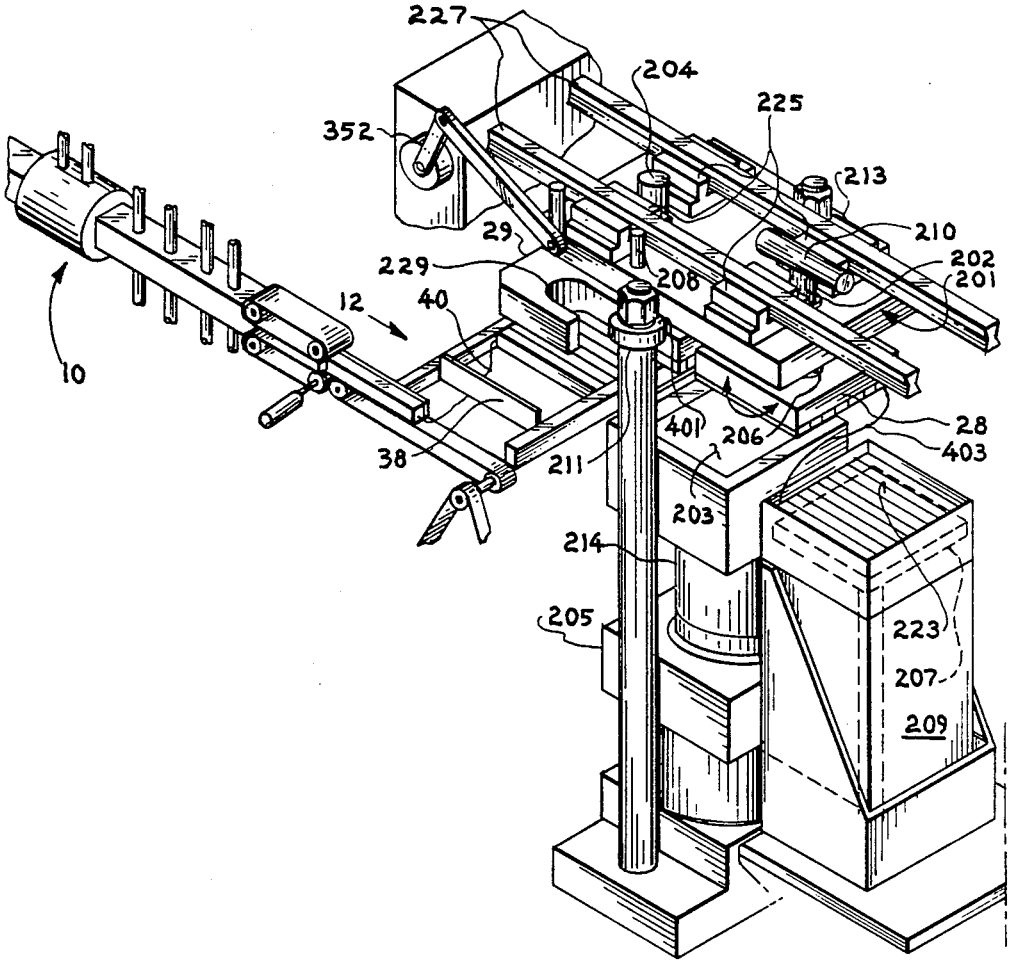
FIG. 1 is a perspective illustration of the major components of this invention.

The apparatus chosen for purposes of illustration is shown in FIG. 1 and includes as its major components a wad forming apparatus generally designated 10 a layer former 12, a layer transfer assembly 201 supported by fixed rails 227 and guides 225 attached to the assembly, having a compression platen 29 and a stacking platen 28; a layer steaming and compression cavity 203, a compression press cylinder 205 and a layer receiving elevator 207 and a container 209 having a moveable bottom for receiving completed packages.

WAD FORMING APPARATUS

Figure 2:
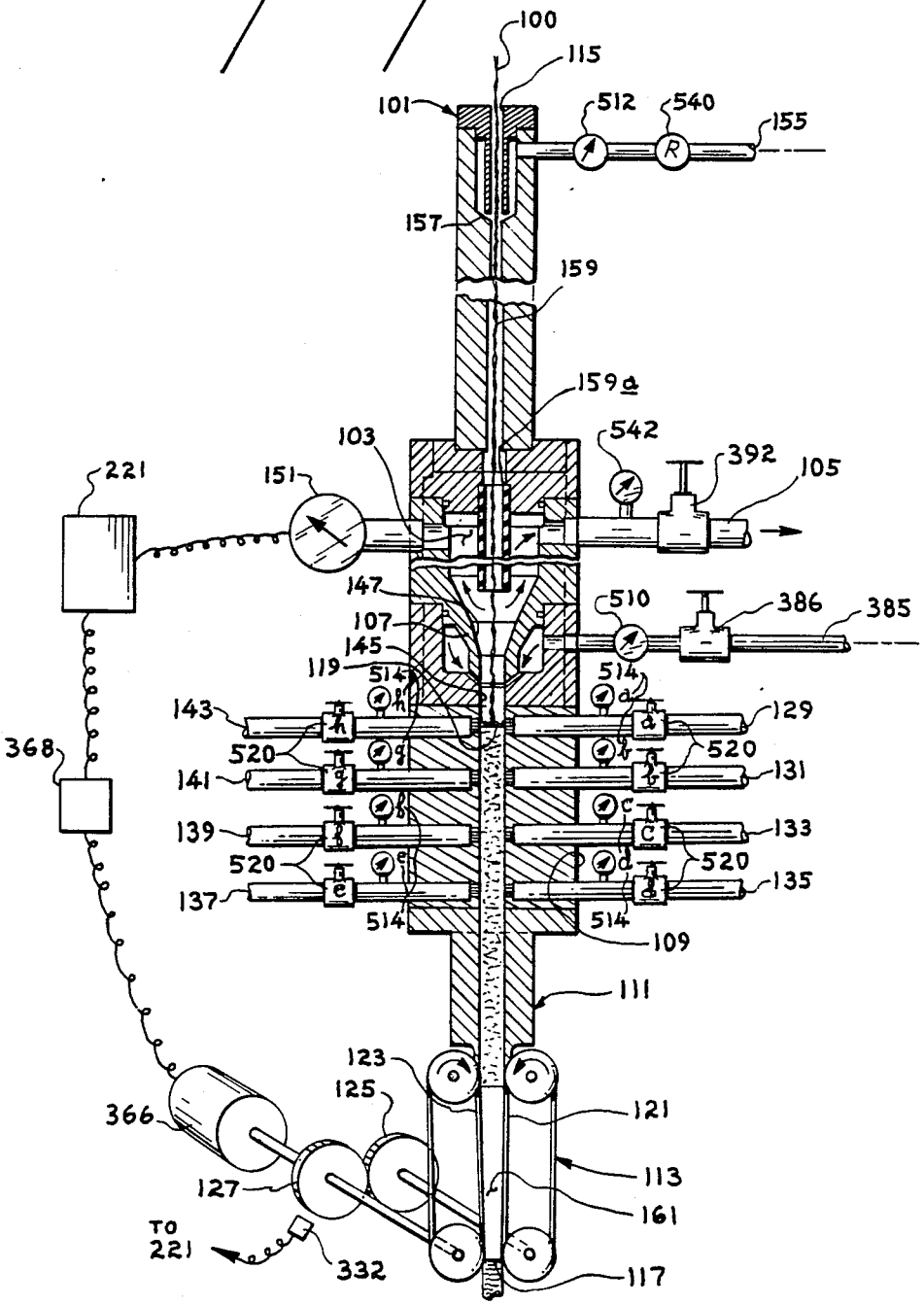
FIG. 2 is a schematic cross sectional view of the wad former.

In the packaging process, the wad forming apparatus 10 plays an important role of making a wad that can be handled to make a wad layer. Such a wad should hold a stable continuous shape when supported only by a horizontal surface after exiting the wad forming apparatus. In FIG. 2 the wad forming apparatus is seen to comprise a yarn tensioning and forwarding jet 101, a fluid pressure chamber 103 and vent 105, a yarn forwarding and heating jet 107, a wad forming and venting section 109, a wad accumulating section 111, and a wad speed control section 113. The relationship of the fluid pressure chamber 103 with the vent 105 is important to providing a compacted wad which can be cleanly segmented along its length. The entrance to chamber 103 from passage 159 is shielded from exhaust vent 105 located at the top of the chamber by a tube **159*a* which extends into the chamber 103 to a location below the vent 105. The vent then can be used to control the pressure in chamber 103 while the tube 159*a* prevents the yarn from being carried through the vent with escaping fluid. The flow of fluid out of the vent 105** is indicated by flow arrows in the chamber.

In this embodiment, wad formation is initiated by feeding a continuous filament yarn 100 into the wad former at entrance 115 and out the exit 117 with the yarn propelled by jets 101 and 107. A solid plug (not shown) is then momentarily inserted over exit 117 to stop the flow of yarn out the exit. The yarn then begins filling up section 113 and 111 forming a compacted wad of yarn. When the wad end reaches section 109, the wad speed control belts 121 and 123 begin moving via motor driven pulleys 125 and 127. The belt speed is controlled so the wad formation point moves up to a location in section 109 at about 119. As the wad moves up into section 109, the pressure in chamber 103 begins increasing since the wad gradually restricts flow out of vents 129, 131, 133, 135, 137, 139, 141, 143 connected to the chamber via passages 145 and 147. As this pressure builds up more fluid is vented out of chamber vent 105 which has a valve 392 to set the pressure in the chamber when the wad end is at the desired position. Pressure sensor 151 senses the pressure level in the chamber and when the preset pressure is reached sends a signal to programmable logic controlled (PLC) 221 which controls the speed of belts 121, 123 to meter the wad out of the exit at the same rate that is is building up at position 119. As long as the forming end of the wad stays near 119, the pressure in the chamber 103, which is exerted on the end of the wad at 119, stays constant. If the wad speed control belts 121, 123 are going slightly too fast, the wad will fall below 119, the pressure will drop and the controller will signal the nip belt motor 366 to slow down until the wad builds back up to 119. If the belts are going too slow, the wad rises above 119, the pressure rises, and the belt motor will speed up slightly and move the wad back to 119 causing the pressure to drop back to the desired level. For different yarns, the wad density, the chamber pressure, and wad position may be different. At the speed control section 113, between the belts, there are guides at 161 perpendicular to the belts that fit closely with the belts to contain the wad.

The pressure acts on the end of the wad to compress it and forward it through sections 109 and 111. If the speed controls belts were absent, the desired pressure would eject the wad rapidly out the exit. The speed control belts, therefore, act to restrain movement of the wad due to the pressure in chamber 103 acting on the wad end at 119. Because of this restraint, the pressure can be set at a pressure somewhat higher than a "free flowing" stuffer to achieve a higher wad density.

The fluid used in tensioning and forwarding jet 101 can be room temperature air under pressure of about 90 psig. If desired the air can be heated, for example when working with light denier yarns. The compressed air entering at 155 passes through an annular opening at 157 to provide uniform tensioning and forwarding of the yarn down the gradually expanding passage 159. The yarn and the jet entrain additional air and draw it into entrance 115.

For heavy denier nylon yarns, the fluid used in the forwarding and heating jet 107 is preferably saturated steam. When room temperature air is used in jet 101 and a heated fluid is used in jet 107, the presence of vent 105 is especially advantageous in allowing increased heating efficiency of jet 107 as the majority of the room temperature air passes out vent 105 before reaching the wad end at 119. For light denier yarn, fluid injection with jet 107 and fluid release from venting section 109 may not be required as hot air supplied from jet 101 may be sufficient. The temperature of the wad as it forms at 119 should be near or above the glass transition temperature of the fiber, therefore allowing the fiber to relax and retain a compact form.

The pressure in chamber 103 to form a dense wad is about 20 psig and 126° C. The chamber 103 and vent 105 provide an important function. It is thought that they reduce the flow of high velocity fluid at the forming end of the wad, particularly from jet 101. This results in reduced turbulence at the wad end so fiber loops are not blown back up section 107 thereby creating connecting fibers along the wad longitudinal axis and alleviates excessive "cupping" in the wad cross-section, both of which would otherwise make clean segmenting of the wad very difficult.

The wad forming and venting section 109 and accumulating section 111 serve to hold the wad at an elevated temperature in a compacted state and for a time long enough at the highest wad speed to cause the fibers to relax in the desired wad form. If this time is too short or temperature too low, the wad will "blossom" when exiting the wad former and the retained wad shape, density and cohesiveness will be too low to handle the wad without it breaking up. In operation, the wad while holding its cross-sectional shape expands considerably in the axial direction as it leaves the belts at 117 so that the wad speed beyond the exit is up to 50% faster than the wad speed in the former determined by the speed control belts.

LAYER FORMER

Figure 3:
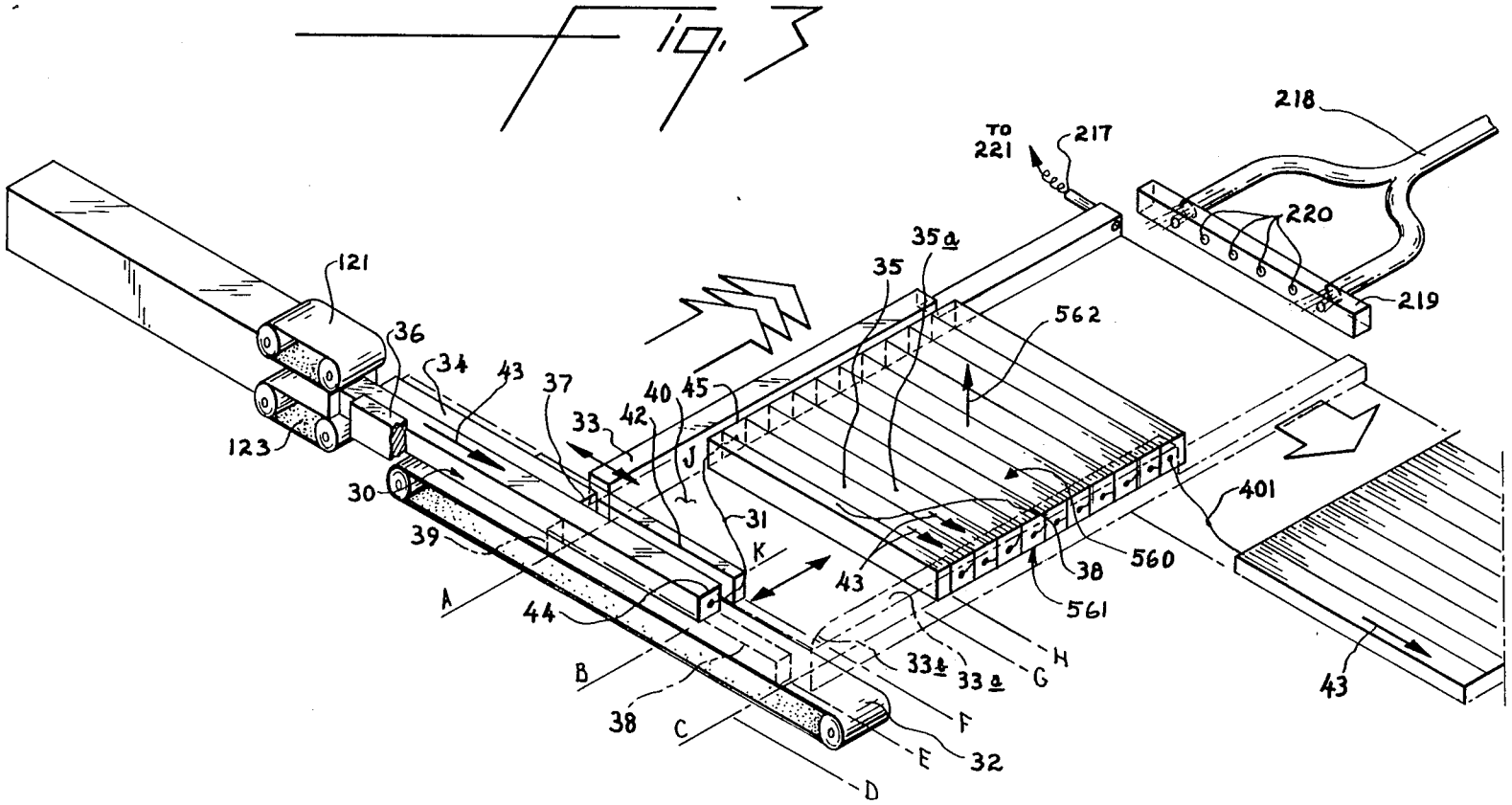
FIG. 3 is a schematic perspective view of the layer formation process.
Figure 4:
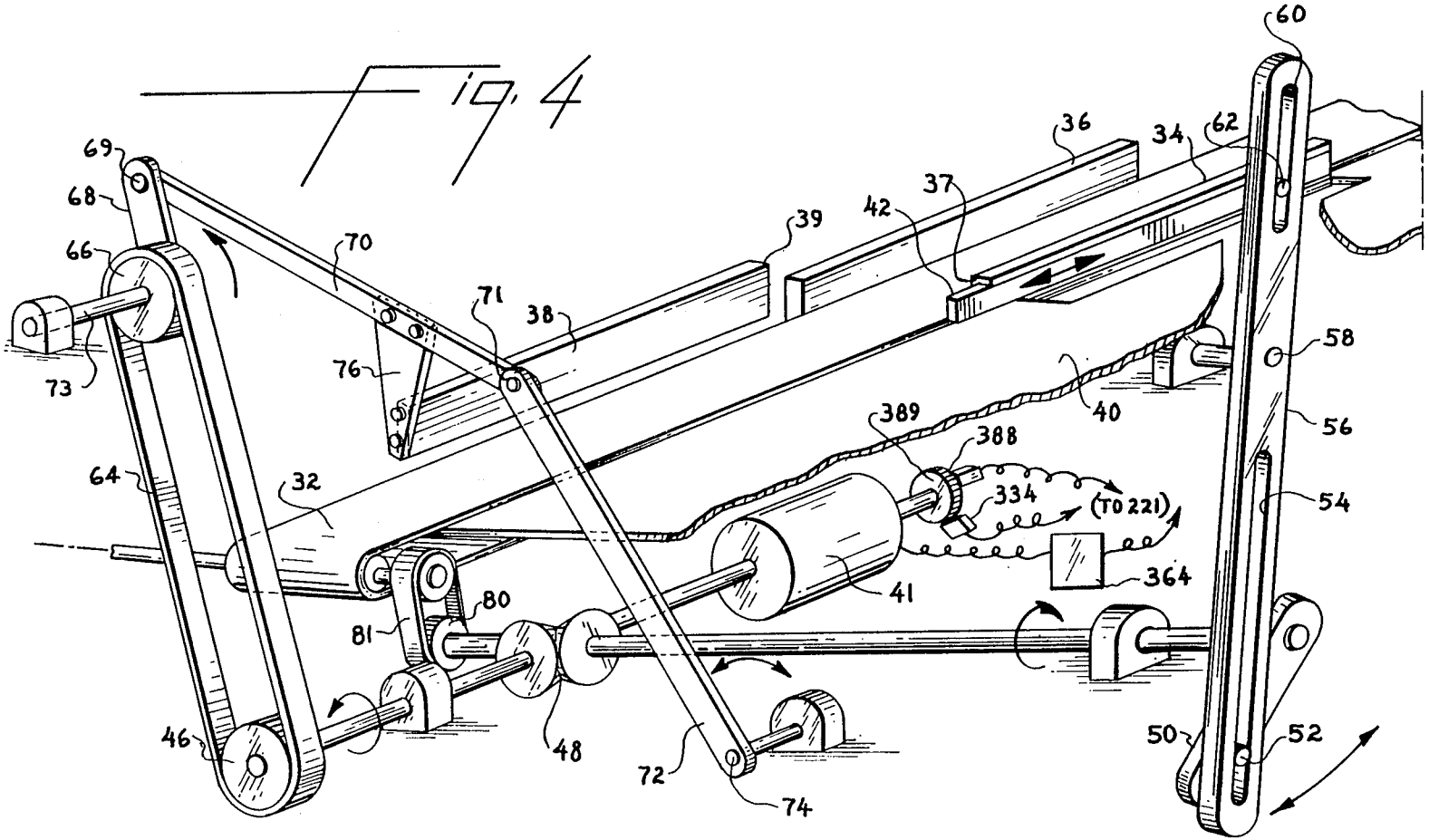
FIGS. 4 and 5 are schematic illustrations of the wad separating apparatus and its linkage trajectory, respectively.
Figure 5:
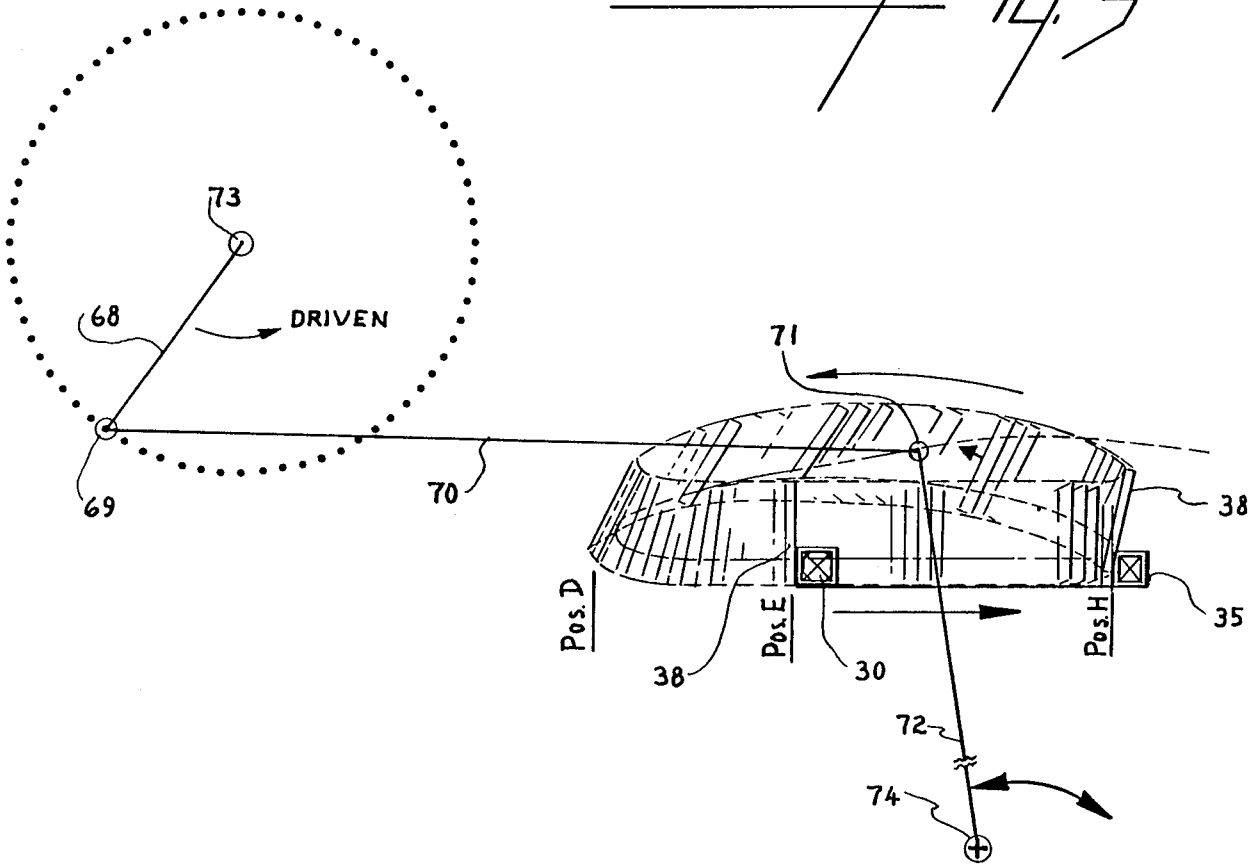

Referring now to FIGS. 3, 4 and 5, the advancing wad 30 is carried by belt 32 to the position of full segment length between A and C, accompanied by a movable guide 42 to laterally support the wad. The speed of belt 32 is up to about 50% faster than the wad speed in the wad former, since the wad expands as it leaves the wad former. The wad is laterally guided by rigid guides at 34 and 36 (36 cut away for clarity in FIG. 3) to control wad buckling and bending especially during segmenting. The guides 34 and 36 define a space between them that fits closely with the sides of the wad and extends to position A.

As the wad 30 approaches position C, the separator blade 38 accelerates from position D to position E, reaching a speed greater than the advancing wad speed, where it contacts the advancing wad just as the wad reaches position C. The separator blade pushes the wad across the moving belt causing it to segment between the rigid guide wall end 37 and the separator blade end 39. The wad 30 is segmented to form a compacted length 35 which is then pushed between fixed guides 33 and 33*a* onto plate 40. The plate may be heated to control condensation of moisture that in turn controls friction between the wad layer and the plate. The separator blade end 39 passes close to the guide wall end 37 allowing enough space for the individual fiber 31 (stripping away from the wad) to pass. The separator blade 38 crosses the wad path quickly enough so that no appreciable buckling of the advancing wad occurs and very little advance of the length along the blade occurs. Guide 33*a* is chamfered at 33*b* to reposition any excessive advance of the compacted length 35 along the blade.

The movable guide 42 begins extending beyond position J to guide the advancing wad as soon as the separator blade clears position F beyond the moveable guide. The movable guide 42 laterally supports the advancing wad as the individual fiber extended length 31 continues to be pulled from the advancing wad end 44 and the segmented wad end 45. The wad end 45 is laterally supported by the separator blade 38. The moveable guide quickly accelerates to a speed approximating the wad speed.

The compacted length 35 being pushed by the separator blade 38 contacts the preceding compacted length 35*a* as the blade reaches position G and pushes it and any other preceeding lengths along between layer guides 33 and 33*a* for a distance of one wad width.

The separator blade decelerates and stops at position H and the moveable guide 42 decelerates and stops at position K with the advancing wad at about position B. At this point, the individual fiber length 31 between the advancing wad end 44 and the compacted length end 45 is about the length of one compacted length 35.

The separator blade 38 then begins to rise and retract at position H and the moveable guide 42 beings to retract at position K. The wad 30 continues advancing toward position C.

The separator blade 38 retracts up and over the moveable guide and advancing wad to position D and the moveable guide retracts to position J. FIG. 5 is a view of the end of the wad separator blade 38 and shows the resulting trajectory of the blade.

The advancing wad then approaches position C and the segmentation cycle repeats until a full layer is formed.

Wad 30 and compacted lengths 35, 35*a* segmented from wad 30 have a common axial direction defined by arrows or vectors 43. In the embodiment described above, the compacted lengths and extended lengths are arranged one next to the other in a layer wherein the axial direction of each compacted length is the same. The layer being formed has opposed major planar surfaces such as top 560 and bottom 561. These surfaces are facing in a common direction for each layer as it is formed, the direction defined by arrow or vector 562 shown perpendicular to the opposed surfaces.

A mechanism to accomplish the synchronous motions between the separator blade 38, moveable guide 42 and belt 32 is shown in FIG. 4. A motor 41 simultaneously drives pulley 46, crank arm 50 and pulley 80 through right angle gearing 48. Crank arm 50 has an attached follower 52 that rides in slot 54 of pivot arm 56 which pivots at support 58. At the upper end of pivot arm 56 is another slot 60 that engages follower 62 attached to moveable guide 42. Moveable guide 42 is restrained to move linearly, as shown, by any suitable bearing arrangement. As crank arm 50 rotates, arm 56 oscillates about support 58 causing moveable guide 42 to move linearly back and forth. At the same time as crank arm 50 is rotating, pulley 46 is driving belt 64 which in turn rotates pulley 66 about support 73. Crank arm 68 is attached to and rotates with pulley 66. Crank arm 68 is attached to one end of link 70 by pivot 69, the other end of which is attached by pivot 71 to link 72 which pivots about support 74. Separator blade 38 is rigidly attached to link 70 by support 76 and follows the trajectory shown in FIG. 5. The motor 41, by driving pulley 80, also drives belt 81 to drive wad conveyor belt 32. The two crank arms 50 and 68 travel through one complete revolution in the same time. By adjusting the angular relationship of these two crank arms, the desired synchronous motion between the separator blade 38 and moveable guide 42 is achieved and is synchronized with the wad advance via the commonly driven wad conveyor belt 32.

PACKAGE FORMER

A transfer assembly 201 (FIG. 1) is used to move a layer of wads to the steaming and compressing cavity 203 and from cavity 203 to package carton 209. On the transfer assembly, each platen 29 and 28 has a vacuum source connected to it. Platen 29 and platen 203 have a narrow slots (not shown) in their face which are aligned parallel to the wad axis to avoid sucking or compressing individual fibers from the wad into the slots since the fibers are generally clumped in platelets that are aligned perpendicular to the wad axis. While platen 28 is not subject to heavy loading platen 29 and cavity 203 must be strong enough to support the compression load imposed on them by press cylinder 205. Platen 29 has a cylinder actuator 204 and linear guide 208 to permit it to move up and down. Platen 28 has a linear rotary guide 206 and a cylinder actuator 202 which allows up and down motion. In addition, platen 28 has a rotary actuator 210 to permit 90° rotation to alternate the orientation of the layers as they are stacked. This may be desired to produce a more stable package structure. In the compression position of the transfer assembly, platen 29 has an extreme up position where it engages stops 211 and 213.

The steaming and compressing cavity 203 is mounted on top of press ram 214 of press cylinder 205. The bottom of the cavity has slots like the face of platen 29 through which steam can be injected into the wad. The cavity width, length and height dimensions are slightly greater than the uncompressed layer dimensions. As the layer is compressed, its height decreases and its width and length increase. The layer edges may contact the cavity sides under full compression load, although such contact is not essential to the process. Maximum package density occurs, however, when contact takes place so each layer takes on a uniform rectangular shape that closely fits in the package carton 209. During compression, the vacuum head of platen 29 fits closely inside cavity 203.

Figure 13:
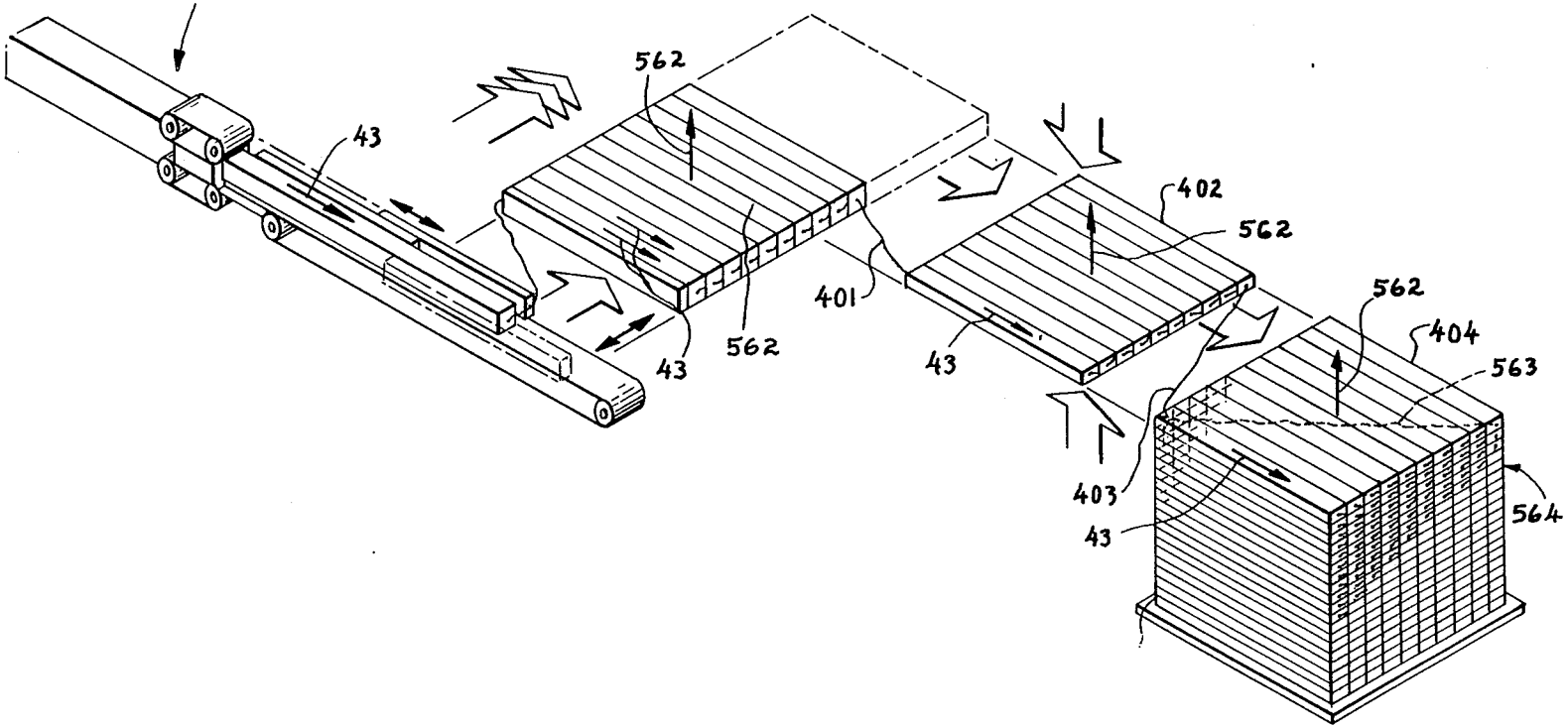
FIG. 13 is a schematic perspective view of the assembling steps for the package.

In operation, segmented wad lengths are accumulated one next to the other on heated plate 40. A series of air jets 220 in manifold 219 supplied with air through pipe 218 (FIG. 3) impinges on the side of the nearest segment to keep it aligned against the other segments. A sensor at 217 detects the presence of the leading segmented wad length, thereby indicating when a full layer is available for pickup. At this point transfer assembly 201 is at the pickup position with platen 29 over plate 40 and platen 28 over cavity 203. Both platen 28 and 29 are driven down under control of PLC 221 as soon as wad separator blade 38 is forward as signalled by sensor 388. More particularly as shown in FIG. 4, toothed gear 389 fixed to motor 41 and gear sensor 388 are used to determine the position of the separator blade 38. Platen 28 contacts a compressed layer in cavity 203 and platen 29 contact an uncompressed layer of compacted lengths on plate 40. The uncompressed layer consists of some whole number of compacted lengths, for example, ten lengths. PLC 221 energizes the vacuum to both platen 28 & 29 when it directs both to descend. After a slight time delay for the vacuum to grasp the layers, both platens 28 & 29 are raised up. Once the platens are in the up position, transfer assembly 201 is shifted, under control of PLC 221, to the position where platen 29 is over cavity 203 and platen 28 is over box 209. The yarn segment connecting the last compacted length in one layer and the first compacted length in the next layer forms the extended length connecting two layers such as 401 and 403 (FIGS. 1, 3, 13). If additional length is required in the extended segment between layers, it can be pulled from the last and first compacted lengths. At this position, platen 28 is lowered to place its compressed wad layer on top of the stack of layers at 223 in container 209. The vacuum to platen 28 is released, and platen 28 is raised up leaving the compressed layer behind on the stack. The stack elevator 207 then lowers the free floating bottom of container 209 thereby lowering the stack until it has moved one wad layer thickness. The stack is now ready to receive another compressed layer.

Simultaneously with the stacking step, the uncompressed layer is compressed. Platen 29 has cut-outs, such as 229, that pass under stops 211 and 213 as platen 29 moves into position over cavity 203. Platen 29 remains up as the cavity 203 is raised by press cylinder 205. Just before the bottom of the cavity contacts the wad layer on platen 29, depending on the material being processed, steam may be passed through the slots in the cavity and the vacuum to platen 29 is turned off. Release of the vacuum drops the wad layer into the steaming cavity and allows the wad segments to expand in lateral dimensions since the vacuum has a slight compressive effect. The cavity continues advancing upward and presses the segmented wad lengths against platen 29. Platen 29 moves up until it contacts stops 211 and 213. These stops are attached to the press frame to enable high compression forces to be exerted against platen 29 to compress the layer. As compression of the layer takes place, the vacuum on platen 29 is turned on again to facilitate flow of steam and condensate through the wad layer. After a time delay, the steam is turned off, the vacuum is turned off, and the cavity 203 is lowered. The compressed wad layer remains in the cavity to be picked up later by platen 28. This completes the cycle. Meanwhile a new layer of ten compacted lengths has been collected on plate 40 and the cycle is ready to repeat.

By compressing a single layer at a time, steam penetration and subsequent water removal is rapid and therefore compression cycles can be rapid as compared to the compressing of an entire package. In contrast, the simultaneous compression of an entire package often requires thick-walled compression containers with extended treatment times and subsequent repacking necessary.

When the container such as 209 is full the container bottom rests on ledge supports (not shown) that support the floating bottom and through which the elevator can clearly move past. An operator moves the full container out of the receiving position and moves an empty container to the receiving position. These operator functions can be mechanized if desired.

CONTROLLER

Figure 6:
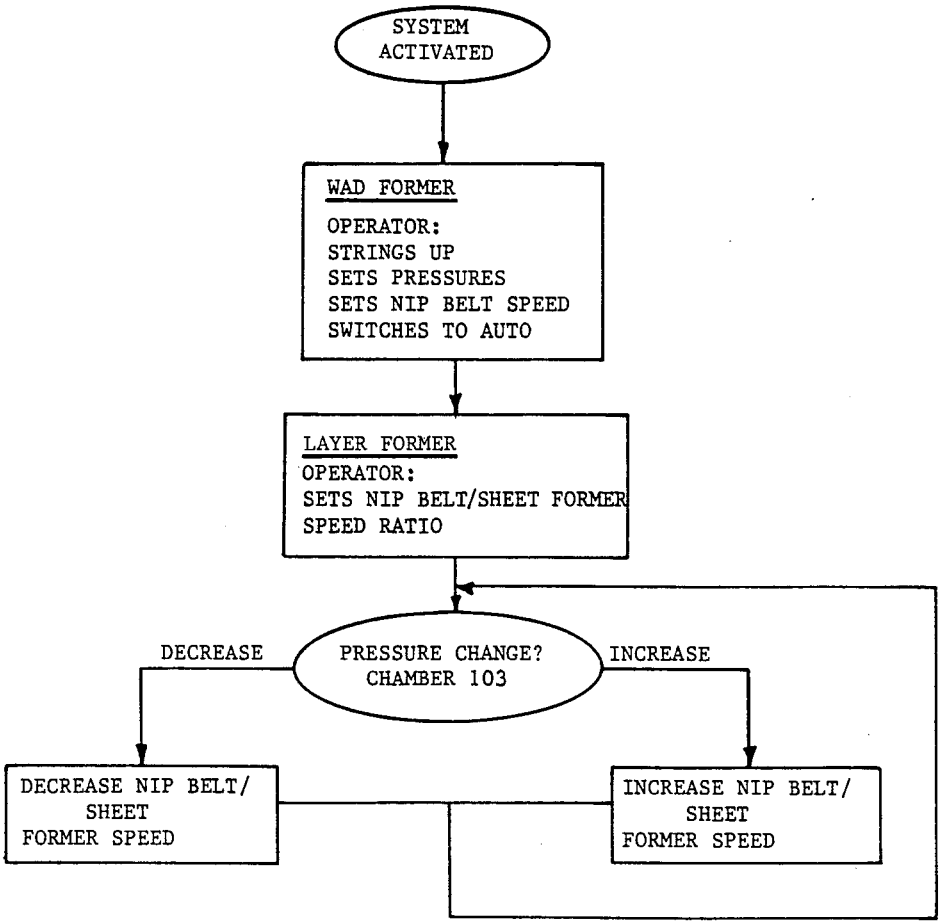
FIGS. 6 and 7 are logic diagrams for the wad former, layer-former and package former of this invention.
Figure 7:
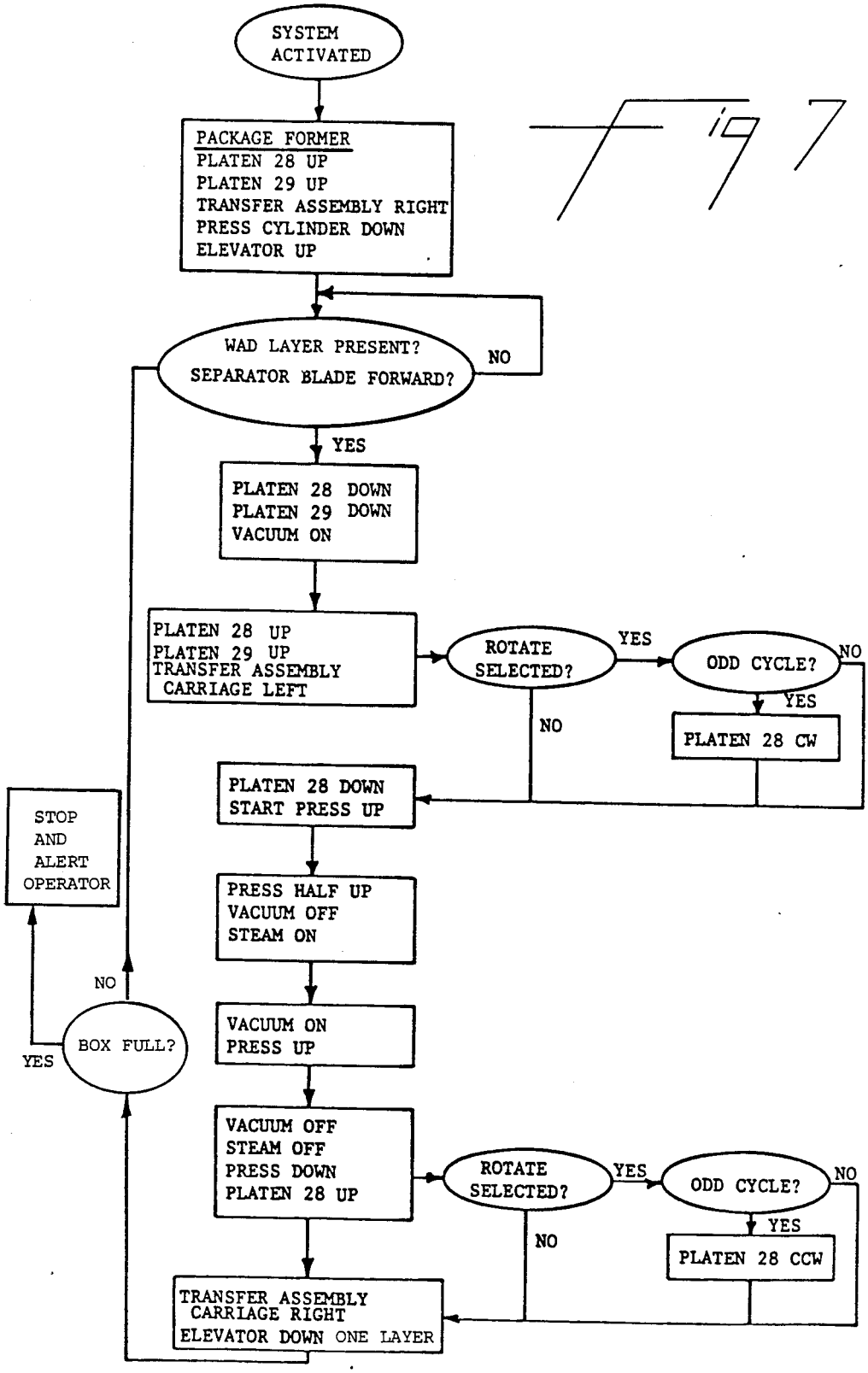
Figure 8:
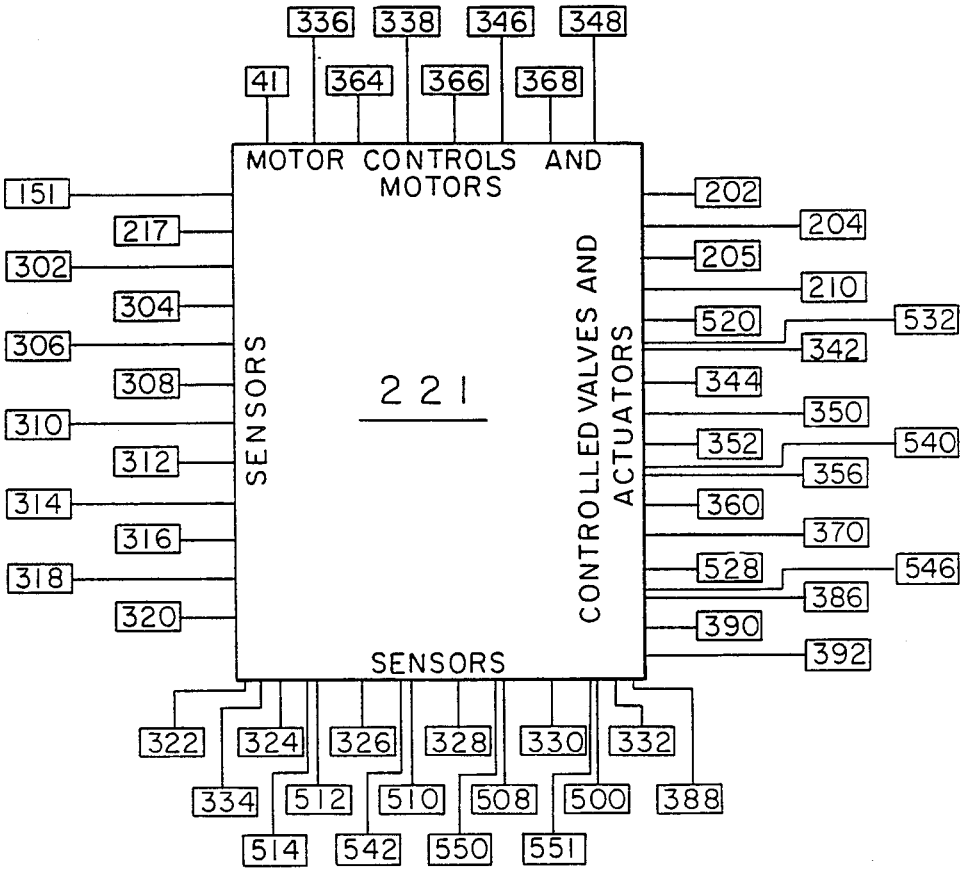
FIG. 8 is a block diagram of the control features of the invention.

A programmable logic controller (PLC) 221 controls the entire wad packing system. A suitable PLC 221 is the Allen-Bradley PLC-2/30 Processor, cat. #1772-LP3 combined with cat. #1771 type I/O components. Such a device is provided by Allen-Bradley Corp., Industrial Computer Group - PLC Division, Cleveland, Ohio. Flow charts of the control system are shown in FIGS. 6 and 7. All inputs and outputs go through PLC 221 (FIG. 8). These include sensors, motor speed controllers and motors; and valves and actuators all listed below in tabular form with more detailed descriptions. The PLC 221 uses conventional control techniques and programmed logic to monitor inputs, and take basic control steps to achieve proper timing of functions, avoid interfering motions, take corrective actions, and terminate operation under undesirable or uncontrollable conditions.

| ELEMENT NO. | GENERIC NAME | MODEL NO. | MANUFACTURER | CITY, STATE |
|---|---|---|---|---|
| | | SENSORS | | |
| 151 | PRESSURE TRANSDUCER | PX841 | OMEGA ENGINEERING, INC. | STAMFORD, CT |
| 217 | OPTICAL SENSOR & CONROL | C17303 F17302 | SKAN-A-MATIC CORP | ELBRIDGE, NY |
| 302 | MAGNETIC REED SWITCH | AB12 | PHD, INC. | FORT WAYNE, IN |
| 304 | MAGNETIC REED | AB12 | PHD, INC. | FORT WAYNE, IN |

-continued

| ELEMENT NO. | GENERIC NAME | MODEL NO. | MANUFACTURER | CITY, STATE |
|---|---|---|---|---|
| | SWITCH | | | |
| 306 | MAGNETIC REED SWITCH | AB12 | PHD, INC. | FORT WAYNE, IN |
| 308 | MAGNETIC REED SWITCH | AB12 | PHD, INC. | FORT WAYNE, IN |
| 310 | MAGNETIC REED SWITCH | MRS-087 | BIMBA MANN CO. | MONEE, IL |
| 312 | MAGNETIC REED SWITCH | MRS-087 | BIMBA MANN CO. | MONEE, IL |
| 314 | MAGNETIC REED SWITCH | PV40-C | GRI | KIMBALL, NB |
| 316 | MAGNETIC REED SWITCH | PV40-C | GRI | KIMBALL, NB |
| 318 | MAGNETIC REED SWITCH | MRS-087 | BIMBA MANN CO. | MONEE, IL |
| 320 | MAGNETIC REED SWITCH | MRS-087 | BIMBA MANN CO. | MONEE, IL |
| 322 | MAGNETIC REED SWITCH | PV40-C | GRI | KIMBALL, NB |
| 324 | MAGNETIC REED SWITCH | PV40-C | GRI | KIMBALL, NB |
| 326 | MAGNETIC REED SWITCH | PV40-C | GRI | KIMBALL, NB |
| 328 | MAGNETIC REED SWITCH | PV40-C | GRI | KIMBALL, NB |
| 330 | MAGNETIC REED SWITCH | PV40-C | GRI | KIMBALL, NB |
| 332 | MAGNETIC SPEED PICKUP | 087-304-0070 | AIRPAX CORP. | CHESHIRE, CT |
| 334 | MAGNETIC SPEED PICKUP | 087-304-0070 | AIRPAX CORP. | CHESHIRE, CT |
| 388 | MAGNETIC PROXIMITY SWITCH | N12-G08-AN6 | TURCK MULTI-TIPROX, INC. | MINNEAPOLIS, MN |
| 500 | AIR PRESSURE GAGE | 0–60 PSI | ASHCROFT DRESSER IND. INC. | STRATFORD, CT |
| 508 | STEAM PRESSURE GAGE | 0–60 PSI | ASHCROFT DRESSER IND. INC. | STRATFORD, CT |
| 510 | STEAM PRESSURE GAGE | 0–60 PSI | ASHCROFT DRESSER IND. INC. | STRATFORD, CT |
| 512 | AIR PRESSURE GAGE | 0–200 PSI | ASHCROFT DRESSER IND. INC. | STRATFORD, CT |
| 514 | A-H AIR/STEAM PRESSURE GAGE | 0–60 PSI | ASHCROFT DRESSER IND. INC. | STRATFORD, CT |
| 542 | AIR/STEAM PRESSURE GAGE | 0–60 PSI | ASHCROFT DRESSER IND. INC. | STRATFORD, CT |
| 550 | MAGNEHELIC VACUUM GAUGE | 2020 | DWYER INSTRUMENTS, INC. | MICHIGAN CITY, IN |
| 551 | MAGNEHELIC VACUUM GAUGE | 2020 | DWYER INSTRUMENTS, INC. | MICHIGAN CITY, IN |
| | CONTROLLED VALVES AND ACUTATORS | | | |
| 202/210 | LINEAR/ROTARY AIR CYLINDER | MA11RF 6090X2-PK-BC-B1-B2-F M | PHD, INC. | FORT WAYNE, IN |
| 204 | AIR CYLINDER | MRS-50-1-½-DXPZ | BIMBA MANN CO. | MONEE, IL |
| 205 | HYDRAULIC | 1584-32-23-S | MILWAUKEE CYLINDER CO. | CUDAHY, WI |
| 342 | 4-WAY HYDRAULIC SOLENOID VALVE | 0F-5M-FF-10A3 | DOUBLE A; BROWN & SHARPE FLUID POWER DIV. | MANCHESTER, MI |
| 344 | 4-WAY AIR SOLENOID VALVE | 6211A-212-PM-1120A | MAC VALVES, INC. | WIXOM, MI |
| 350 | 4-WAY HYDRUALIC SOLENOID VALVE | 0F-5M-C-10A2 | DOUBLE A; BROWN & SHARPE FLUID POWER DIV. | MANCHESTER, MI |
| 352 | HYDRAULIC ROTARY ACTUATOR | 3720-1010-180 | FLOTORK, INC. | ORRVILLE, OH |
| 356 | 4-WAY AIR SOLENOID VALVE | 6211A-212-PM-1120-A | MAC VALVES, INC. | WIXOM, MI |
| 360 | 4-WAY AIR SOLENOID VALVE | 6211A-212-PM-1120-A | MAC VALVES, INC. | WIXOM, MI |
| 370 | 2-WAY STEAM SOLENOID VALVE | 8222 A49 | ASCO ELECTRICAL PROD. CO., INC. | PARSIPPANY, NJ |

-continued

| ELEMENT NO. | GENERIC NAME | MODEL NO. | MANUFACTURER | CITY, STATE |
|---|---|---|---|---|
| 386 | STEAM GATE VALVE | ½ GATE | HENRY VOIGHT MACHINE CO. | LOUISVILLE, KY |
| 390 | 4-WAY AIR SOLENOID VALVE | 6211A-212-PM-1120-A | MAC VALVES, INC. | WIXOM, MI |
| 392 | BALL VALVE | ¾-21-1100TT-0 | JAMESBURY CORP. | WORCHESTER, MA |
| 520 | AH BALL VALVE | 4P4T4 | NUPRO CO. | WILLOUGHBY, OH |
| 528 | STEAM PRESSURE REGULATOR | 667-A | FISHER CONTROLS INTL. INC. | MARSHALLTOWN, IA |
| 532 | AIR PRESSURE REGULATOR | R12-400 RGLA | C.A. NORGREN CO. | LITTLETON, CO |
| 540 | AIR PRESSURE REGULATOR | R12-400 RGLA | C.A. NORGREN CO. | LITTLETON, CO |
| 546 | AIR CYLINDER | MRS-50-6-DXPZ | BIMBA MANN CO. | MONEE, IL |
| | | MOTOR CONTROLS AND MOTORS | | |
| 41 | MOTOR | V97500TF-B | BOSTON GEAR | QUINCY, MA |
| 336 | MOTOR | 42R5BFCI-E1 | B&B MOTOR & CONTROL CORP. | BERLIN, CT |
| 338 | MOTOR STARTER | 8736/SA016 | SQUARE D CO. | MILWAUKEE, WI |
| 346 | MOTOR | VM3613 | BALDOR | FORT SMITH, AK |
| | & BLOWER | RM-87 | PAXTON PROD. INC. | SANTA MONICA, CA |
| 348 | MOTOR SPEED CONTROL | B-1334-EJB | ALLEN-BRADLEY CO. | MILWAUKEE, WI |
| 364 | MOTOR SPEED CONTROL | VEL75-25B | BOSTON GEAR | QUINCY, MA |
| 366 | MOTOR | V97500TF-C | BOSTON GEAR | QUINCY, MA |
| 368 | MOTOR SPEED CONTROL | VEL75-25B | BOSTON GEAR | QUINCY, MA |
| 538 | HYDRAULIC POWER SUPPLY | T80P | DOUBLE A BROWN & SHARPE FLUID POWER DIV. | MANCHESTER, MI |

CONTROLLER OPERATION

The controller 221 in FIG. 8 receives input from sensors on the machine and uses this to control the sequencing of events and to display values to facilitate set-up for different products. The wad former dynamic control can be carried out independently of the layer forming, handling, compressing and stacking activities as long as the proper speed relationship is set up between the nominal speed of the nip belt motor 366 as monitored by sensor 332, and the speed of the separator linkage/conveyor motor 41 as monitored by sensor 334. For a given product set-up this relationship remains fixed. Therefore the control of these two sections of the machine will be explained separately.

Control of the wad former 10 is readily understood by referring to FIGS. 1 and 2. At set up, air pressure regulator 540, fluid flow valve 392, and steam control valve 386 are adjusted to desired levels and monitored by gages 512, 542 and 510 respectively. In addition, valves 520*a–h* at vents 129–143 are adjusted to produce proper flows for a particular yarn product and their effects are monitored by gages 514*a–h*, respectively.

In operation, PLC 221 receives wad nip belt speed signals from sensor 332 and controls the motor 366 speed to maintain the desired pressure in chamber 103 as measured by sensor 151. If the chamber pressure increases, the PLC commands the nip motor speed control 368 to increase the nip motor speed. If the chamber pressure decreases, the PLC commands the controller to decrease the speed. These speed changes are small enough that the speed relationship with the wad conveyor 32 is not changed enough to warrant making any changes in the speed of the layer former motor 41. If desired, however, the speed of motor 41 could be controlled to more closely maintain the desired speed relationship.

Control of the remainder of the machine will be explained referring to FIGS. 1, 3, 4 and 9–13. The PLC 221 commands the layer former motor speed control 364 to cause the conveyor belt 32 to run at a fixed set-up speed relative to the speed of the nip belt motor 366 as explained above. The compression steam pressure is preset via regulator 528 and monitored for display via gage 508. Air pressure to cylinders 204, 202/210, and 546 is supplied via regulator 532 and monitored for display by gage 500. Hydraulic pressure level to cylinder 205 and actuator 352 is set through hydraulic power supply 538 coupled to valves 342, 350. Vacuum level is adjusted by varying the speed of vacuum blower motor 346 by speed control 348 and monitored by gages 550, 551. The separator linkage driven by motor 41 pushes the wad layer across plate 40 until the farthest completed length in the layer is sensed by sensor 217. PLC 38 has reached the end of its forward stroke. The transfer assembly is already in its forward position signaled by sensor 314 with platen 29 up, sensed by sensor 310, over the layer on plate 40 and platen 28 is up over compression cavity 203 sensed by 306 (where during operation a compressed layer is present), compression cavity 203 is down as sensed by 330 and elevator 207 is up as sensed by 322.

When the signals from sensors 217 and 388 arrive, the PLC 221 commands platens 28 and 29 to move down. The PLC actuates valve 356 causing cylinder 204 to move platen 29 down; and actuates valve 360 to cause cylinder 202 to move platen 28 down and turns on the vacuum to both platens by actuating valve 344 to cause cylinder 546 to move vacuum slide valve 400 to the on position directing vacuum to the platens. Sensor 320 signals the PLC when the vacuum is on. When sensors 308 and 312 signal PLC 221 that both platens are down, PLC 221 energizes an internal timer to wait while the vacuum builds up and draws the layer from plate 40 onto platen 29 and the layer in cavity 203 onto platen 28. When the time is up, PLC 221 actuates valves 356 and 360 to cause cylinders 204 and 202 to raise platens 29 and 28 up. Platen 29 lifts a new layer from plate 40 and platen 28 lifts a compressed layer from cavity 203.

Figure 9:
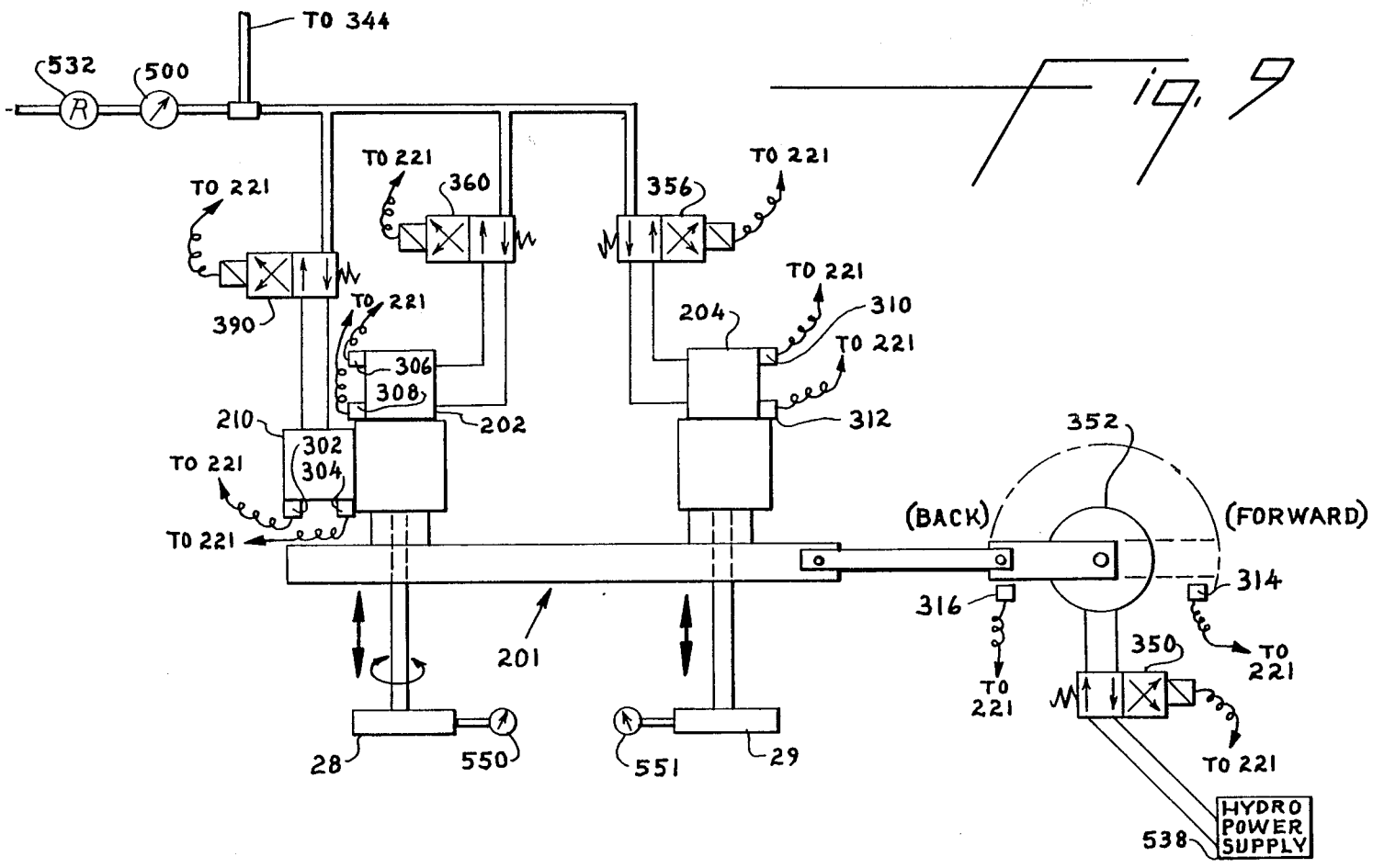
FIGS. 9–12 are schematic control diagrams for elements of the packing system.

When both sensors 310 and 306 signal the PLC 221 that both platens are up, the PLC commands transfer assembly 201 to move backward by actuating valve 350 to move rotary actuator 352 counter-clockwise (to the position depicted in FIG. 9). PLC 221 gets a signal from sensor 316 indicating the backward motion is complete. If it is desired to rotate the layer on platen 28, simultaneously PLC 221 would actuate valve 390 every other cycle to move rotary actuator 210 clockwise and the completion of this would be signaled to the PLC by sensor 302. The PLC then commands platen 28 down as was done above. When platen 28 is down as signalled by sensor 308, PLC 221 simultaneously actuates press valve 342 to cause cylinder 205 to move up which moves the compression cavity 203 attached to the press cylinder ram 214 up to engage platen 29 with its layer.

Figure 10:
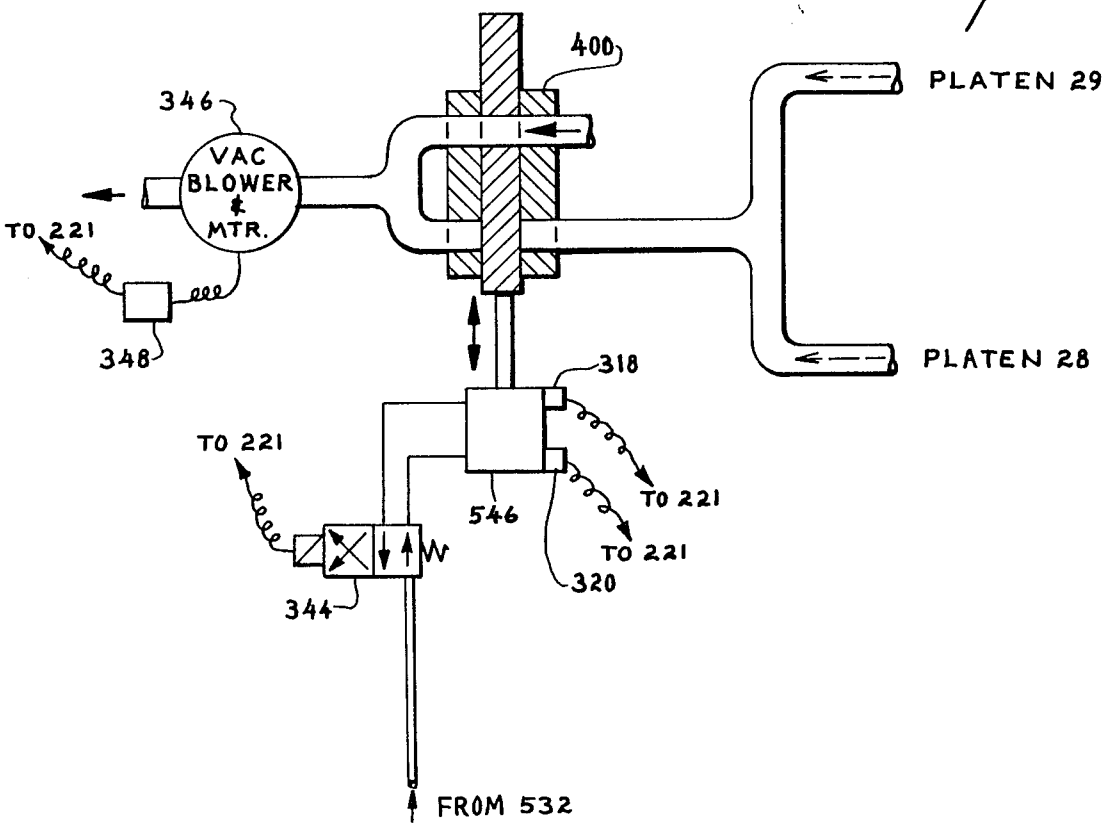
Figure 11:
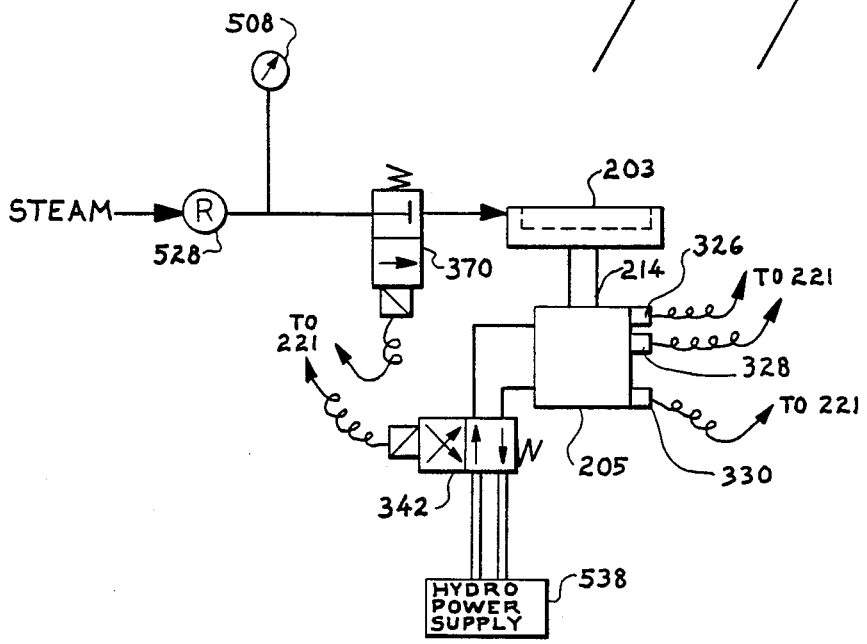
Figure 12:
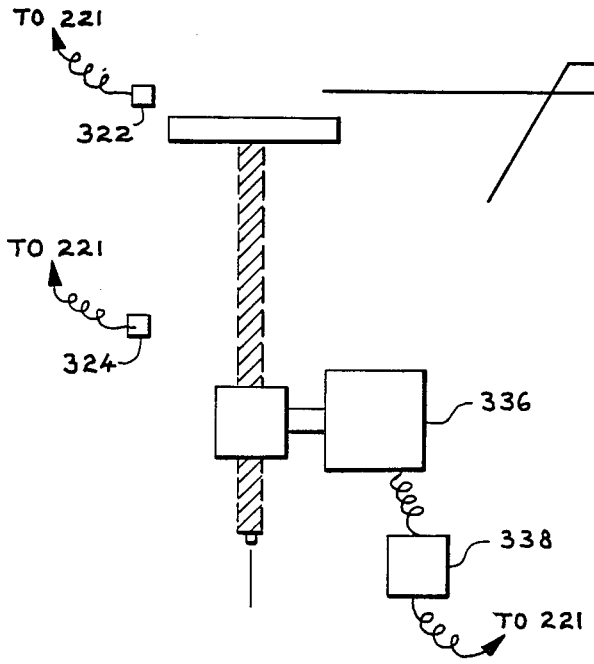

As the cylinder 205 nears the up position just before contacting the layer, sensor 328 signals the PLC 221. The PLC then actuates steam valve 370 to open, releasing steam to the cavity 203, and at the same time actuates vacuum control valve 344 to cause cylinder 546 to shift vacuum slide valve 400 to the off position which will be sensed by sensor 318 as shown in FIG. 10. These actions cause the layer to be released from platen 29 as the steam passes into the layer. (Releasing the vacuum and applying steam at this point may be one way to get the layer to expand and optimally fill cavity 203. This is an optional step that increases packed density.) The compressed layer is also released from platen 28, but since it is in contact with the top layer on the stack at 223, the compressed layer remains in contact with platen 28. Meanwhile, press cylinder 205 reaches the full up position, thereby moving platen 29 up against stops 211, 213 and compressing the layer against platen 29, and sensor 326 signals this to the PLC. PLC 221 now turns the vacuum back on the draw the steam through the compressed layer and turns on internal timers within PLC 221. When the timer settings expire, the PLC turns the steam off via valve 370 and turns the vacuum off via valve 344. The vacuum can be on longer than the steam to affect additional drying of the yarn.

After a short time delay, PLC 221 actuates valve 342 to cause the press cylinder 205 and attached compression cavity 203 holding the compressed layer to move down and actuates valve 360 to move platen 28 up. When sensors 330 and 306 confirm that these motions are complete, PLC 221 actuates valve 350 to move transfer assembly 201 back to its original forward position. Sensor 314 signals the PLC when this motion is complete. At this time, if platen 28 was rotated, PLC 221 would actuate valve 390 to return platen 28 to its original position as sensed by sensor 304. PLC 221 also commands the elevator motor starter 338 to cause the elevator motor 336 to rotate for a predetermined duration to cause the elevator to move the layer stack down the distance of one layer thickness. During the time since last picking up a layer, a new layer has been formed on plate 40 and, of course, the just compressed layer is present in the compression cavity waiting to be picked up. As soon as sensor 217 senses the farthest wad in the new layer and sensor 388 detects the separator blade in its forward position, the layer handling and compression cycle is ready to repeat.

When the stack is complete, the elevator will be at its bottom position as detected by sensor 324 which will signal the PLC. An operator can then respond, remove the full container 209 and replace it with an empty one, and notify the PLC 221. The PLC can then command elevator 207 to move to the top position which will be sensed by sensor 322 and then filling of the empty container can commence.

FIG. 13 shows diagrammatically the packaging process of the invention in which the continuous wad from wad former 10 is formed into a new layer 552, while a first previously formed layer 402, still connected to the new layer, is placed in a compression press where it is compressed to a higher density. A second previously formed layer 404, still connected to the first previously formed layer, has been removed from the compression station and placed on a layer receiving elevator. By forming individual layers from the wad, the layers can be processed independently, such as by compression, while new layers are being formed. This results in finally processed layers that can be packaged directly in a container suitable for storage or shipping. The process can be readily adapted to produce different size layers and thereby different size packages from the same wad former. The final package made from individually compressed layers has a density high enough to compete with conventional wound packages.

The layers shown in FIG. 13 are each stacked one next to another with opposed major surfaces in contact and with all layers facing the same direction; i.e., all arrows 562 are facing up. When the layers 402 and 404, which are side-by-side in about the same plane, are stacked with opposing surfaces contacting and layers facing in the same direction, the extended length has a length at least at long as the shortest axis of the layer. This length is typified by extended length 563 which in this case is as long as the diagonal of a layer. This length permits individual handling of layers such as 402 and 404 and is a characteristic feature of the finished package 564. The extended length is shown in a preferred position between the layers, but if desired it can be further extended if need be and placed at the outer surface of the package out from between the layers.

While FIG. 13 illustrates the preferred layer structure consisting of a structure of segmented wads as described earlier, the process of the invention, however, is not limited to this layer structure. Other layer structures suitable for this process are shown in FIGS. 14 and 15.

Figure 14:
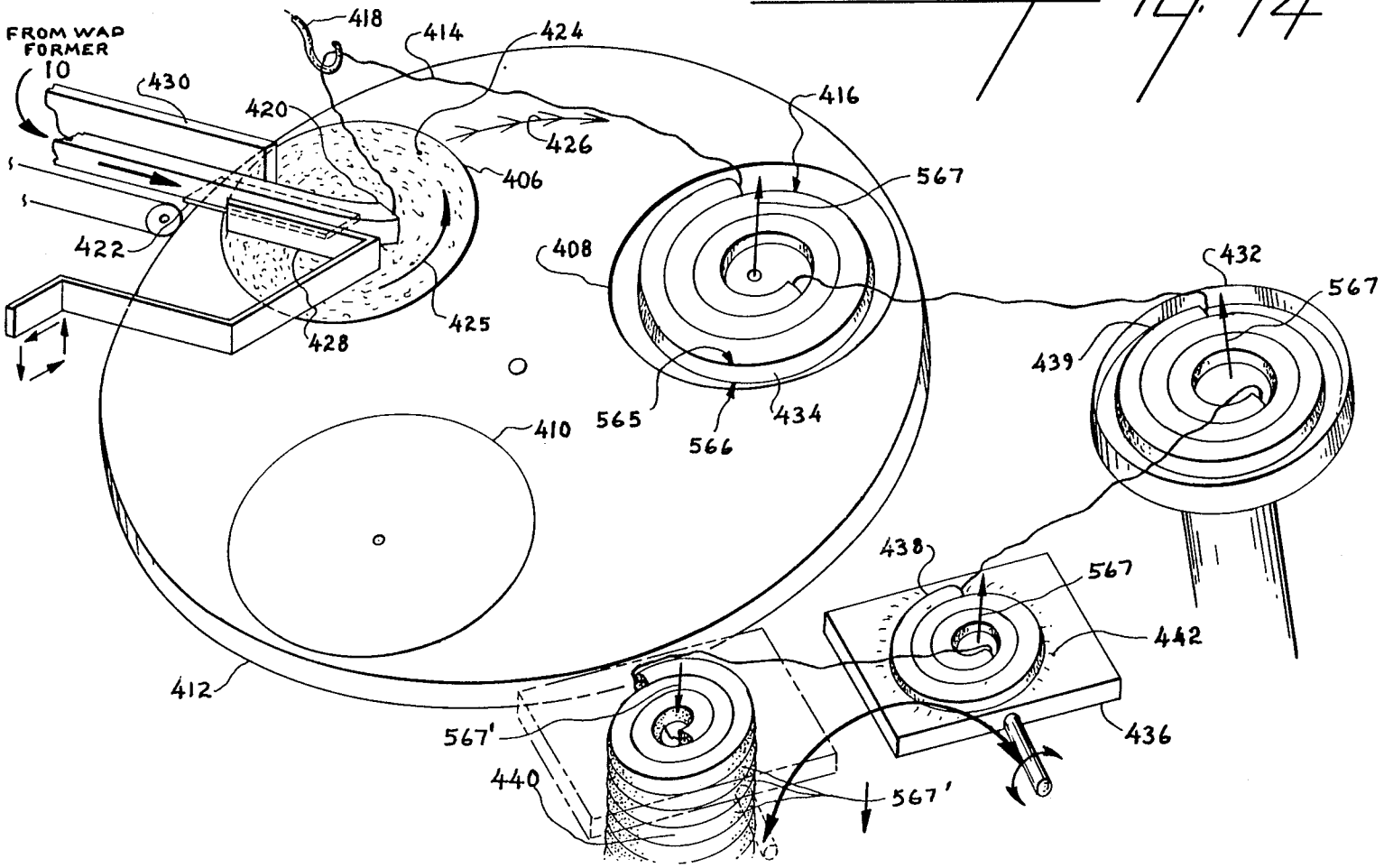
FIGS. 14–15 are schematic illustrations of alternate layer forms useful for the package made according to the invention.

More particularly, in FIG. 14 the wad from the wad former 10 is fed as a compacted length to one of several rotary is fed as a compacted length to one of several rotary vacuum disks 406, 408, 410 on a rotary turntable, 412. The extended yarn length 414 from a first previously formed layer 416 is picked up by eyelet 418. The end of the wad 420 continues feeding out from the wad former, across bridge 422 to the central surface of disk 406. Disk 406 is rotating in a counterclockwise direction as shown by arrow 425 under the bridge 422 and a vacuum is being applied to the surface of disk 406 via vacuum ports such as 424. Upon reaching the disk central surface, the wad end 420 is held to the surface by the vacuum so it follows the rotary motion of the disk. Turntable 412 slowly rotates clockwise as indicated by arrows at 426 to allow the wad, rotated by disk 406, to form a spiral layer wherein the compacted length is arranged next to other portions of the compacted length throughout the layer. When the newly formed layer looks like first previously formed layer 416, turntable 412 moves abruptly and pusher blade 428 moves in unison with it for a short distance to separate the wad. The turntable continues moving until disk 406 moves to the previous position of disk 408 and disk 410 is in the previous position of disk 406. The end of the compacted length in the spiral is separated between blade 428 and stationary wall 430, thereby forming an extended yarn length similar to 414 as the turntable 412 rotates disk 406. The continually forming wad is supported by bridge 422 for the time disk 410 takes to move into the position previously occupied by disk 406. Pusher blade 428 retracts by moving up and over the wad similar to blade 38 of FIG. 1. Prior to or following this movement of turntable 412, first previously formed layer 416 is moved to a compression press 432 from which second previously formed layer 439 has been moved to turnover platen 436. The layers have opposed surfaces, such as top 565 and bottom 566. These surfaces are facing in a common direction for each layer as it is formed, the direction defined by arrow or vector 567 shown perpendicular to the opposed surfaces. Layers are moved over by circular platens similar in operation to platens 28 and 29 described above. Turnover platen 436 would have been empty after turning over and stacking third previously formed layer 438 on the top of package 440. The turnover platen has vacuum ports such as 442 to hold the layer during turnover. Turnover of the layer before stacking is required to keep the extended yarn length oriented properly between the layers in the stack so spiral unwinding can occur. The direction of the layers is reversed by turnover platen 436, but all the layers are still facing in the same direction defined by the now inverted arrows 567'. The final package 440 has the characteristics of the invention in that it is comprised of individual layers of compacted wads arranges next to one another that remain connected by an extended yarn length having a length characteristic of the invention. The extended yarn length has a length at least as long as the diameter of the spiral layer to permit individual handling of the layers. It should be noted that no segmenting of the compacted wad was necessary within a layer to form this particular spiral layer structure.

Figure 15:
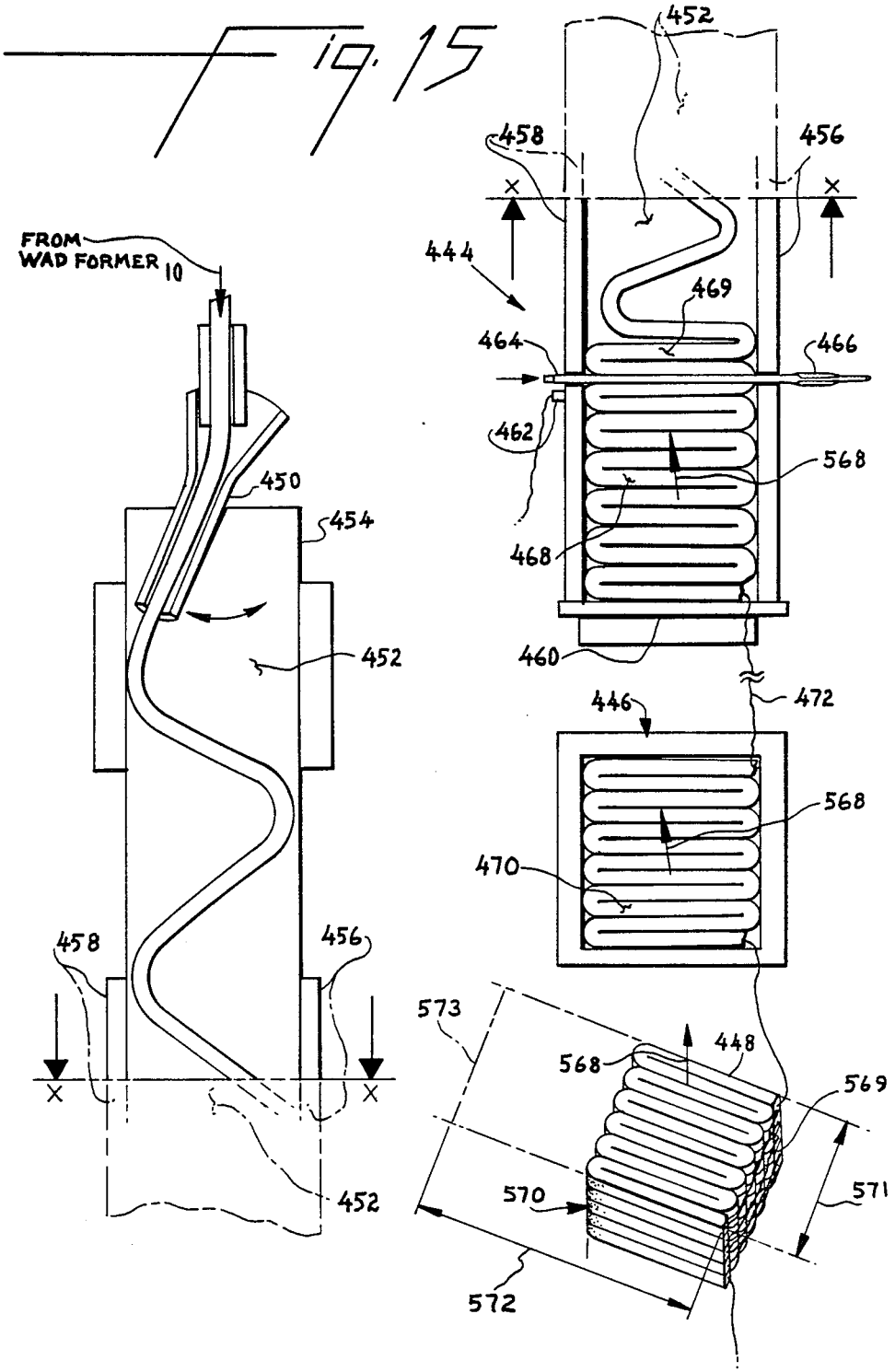

FIG. 15 shows a serpentine layer structure possible when practicing the invention. FIG. 15 is a schematic plan view of an apparatus for forming a serpentine layer structure at location 444, compressing it at location 446, and stacking it at location 448 in a package. The continuous compacted wad advancing from the wad former 10 is fed through an oscillating chute 450 onto a moving belt surface 452. A vacuum plenum 454 may be employed to control the wad at the point of lay-down on the belt. The vacuum would communicate with the wad through perforations (not shown) in the belt as the perforated belt passed over the plenum. The chute oscillation rate and belt speed are coordinated so an S-shaped pattern of compacted wad is placed on the belt. The belt carries the S-shaped wad between lateral guides 456 and 458 and drives it up against stationary end wall 460 when separator blade 464 is retracted (shown extended). When encountering wall 460 the S-shaped pattern of wads folds to form a serpentine layer pattern wherein the compacted length is arranged next to the other portions of the compacted length throughout the layer and continues to build up until sensed by sensor 462. At that time, layer separator blade 464 moves across the wad path and shears out an extended yarn length 466. Extended yarn length 466 connects the new layer 468 to the beginning of layer 469. Layer 468 is moved to compression location 446 while the previous layer 470, already compressed, is moved simultaneously out to the top of the stack of layers at location 448. Layers are moved by overhead vacuum platens similar in operation to platens 28 and 29 as described above. Extended length 472 connects layer 470 to layer 468. As soon as the new layer 468 is removed from the conveyor, blade 464 retracts allowing the beginning of new serpentine layer 469 to move up against wall 460 and the process can repeat. The segmenting of the compacted wad is not necessary within a layer in forming this layer structure. The compacted wad, however, may open up to a less compact wad at the folded ends of the serpentine pattern. The serpentine package 570 shown in FIG. 15 has the layers stacked one next to the other with major planar opposed surfaces in contact and preferably with all layers facing the same direction such as defined by arrow 568. In FIG. 15, arrow 568 is diagramatically shown perpendicular to the page in a direction out from the page. The extended length connecting layers is exemplified by extended length 569 which runs along the side of the package 570. The length of this extended length is at least as long as the axis 571 of this rectangular arrangement of compacted lengths in a layer. Axis 572 of the layer extending to the left of FIG. 15 could be a long major axis as shown by intermittent line 573 while the number of compacted lengths in the layer could be small making 571 the minor axis.

Figure 16:
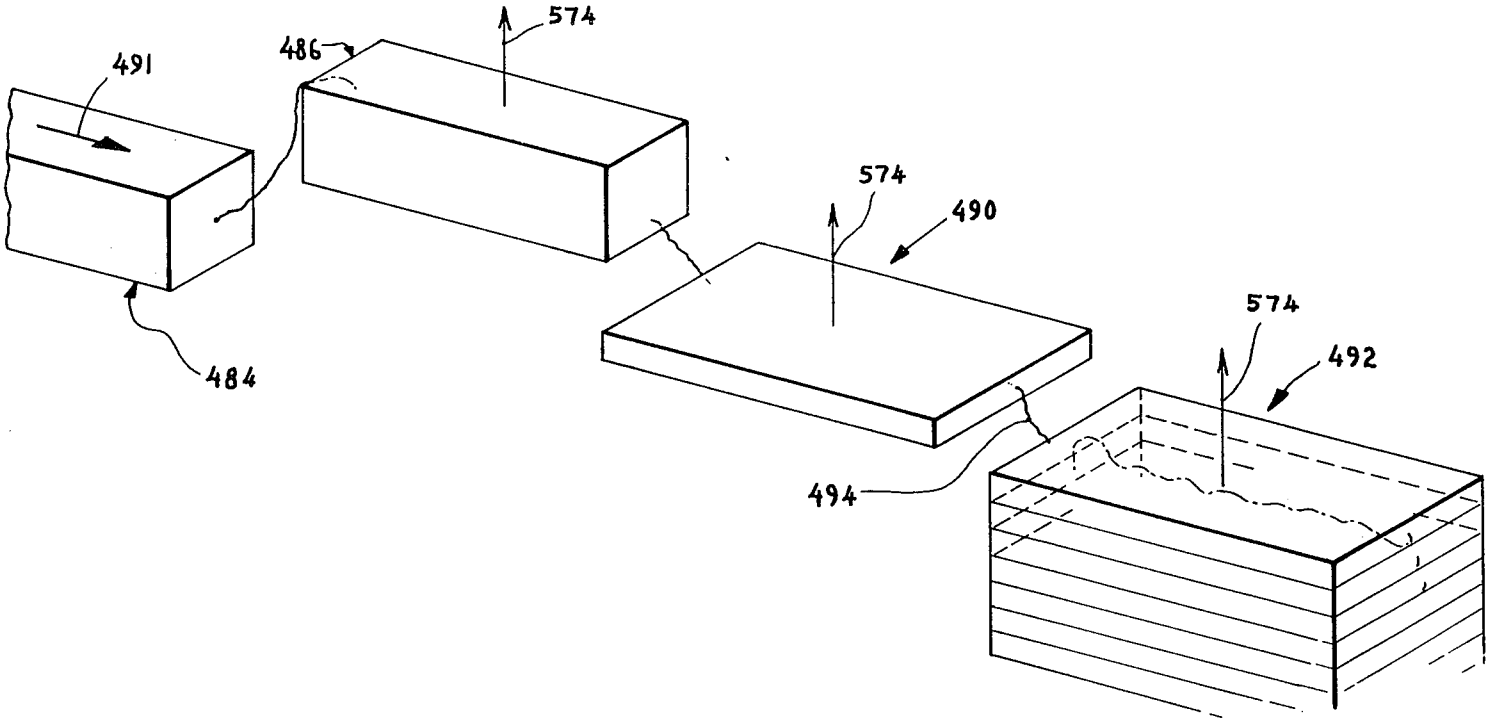
FIGS. 16–19 are schematic illustrations of alternate package forms for the layers of this invention.

FIG. 16 shows still another layer structure of the invention. This layer, instead of being made up of many compacted wads arranged side-by-side in a linear or circular configuration, is made from a single compacted wad 484 having an axial direction defined by arrow 491. Such a wad is separated into distinct segments of alternating extended and axially compacted lengths. Such a compacted length becomes an individual layer 486 and is compacted at location 490, and stacked at location 492. Each wad segment is a layer that has an extended yarn segment such as 494 connecting it to, and preferably positioned between, adjacent layers stacked one next to the other to form a package. The layers such as 486, 490, 492 have major planar surfaces that are opposed to each other, such as a top and bottom. Each of the layers is formed with these surfaces facing in a common direction defined by arrows 574. The layers are stacked one next to the other with an opposed surface of one layer in contact with an opposed surface of the next layer, and preferably with all layers facing the same direction. A large single wad could be made by traversing or oscillating the forwarding jet portion 101, and upstream portions 103, 105 and 107 of a wad former relative to the wad forming and venting section 109 and the remaining downstream sections 111 and 113. Portions 101, 103, 105 and 107 of wad former could be the same scale as in FIG. 2 while the remaining portions 109, 111, and 113 are larger in proportion to the amount of traverse or oscillation employed to make the larger compacted wad. This monolithic compacted wad could take a form ranging from a flat rectangular ribbon to a square form.

Figure 17:
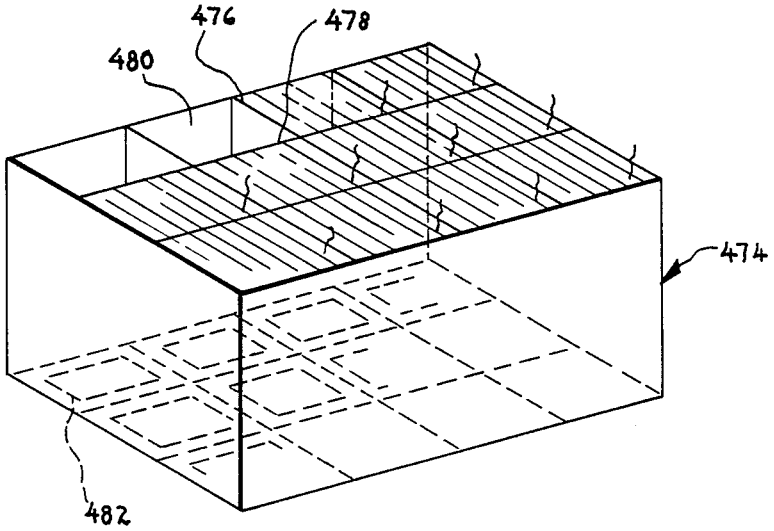

In FIG. 1 the wad layers are shown stacked in a package in an individual container 209. Other arrangements of packages in a container are possible such as the container 474 in FIG. 17. This container has dividers such as 476 and 478 dividing the container into individual compartments such as 480. A package of wad layers would be sequentially stacked in each compartment. Each compartment would have a moveable rectangular bottom that could be contacted via holes in the container bottom such as 482. After filling one compartment, the container would be indexed to the next empty compartment and an elevator similar to elevator 207 of FIG. 1 would be raised to bring the moveable compartment bottom to the top of the compartment to accept the first wad layer for the next package. The extended yarn segment of the last layer for an adjacent package could remain connected to the first layer of the next package to form a large container of continuous yarn. Alternatively, the extended yarn segment could be cut to provide a free end at the last layer of each package as shown. This container configuration results in a very compact large package.

Figure 18:
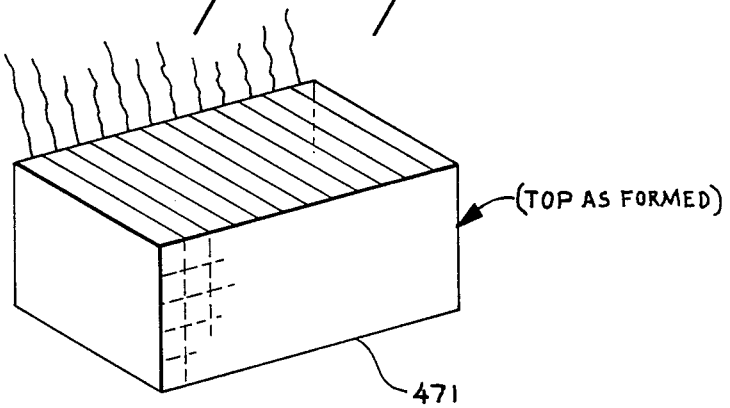

FIG. 18 shows a different orientation of the package in FIG. 1. After packing, the container 209 can be closed at the top. When ready for use, the container side, instead of the top, can be opened exposing the edge of all layers of the package 471. The extended segment connecting the layers is then accessible and can be cut, thereby making the yarn in all layers available simultaneously. This use of the package provides many yarn ends in a compact space and is useful in creeling operations.

Figure 19:
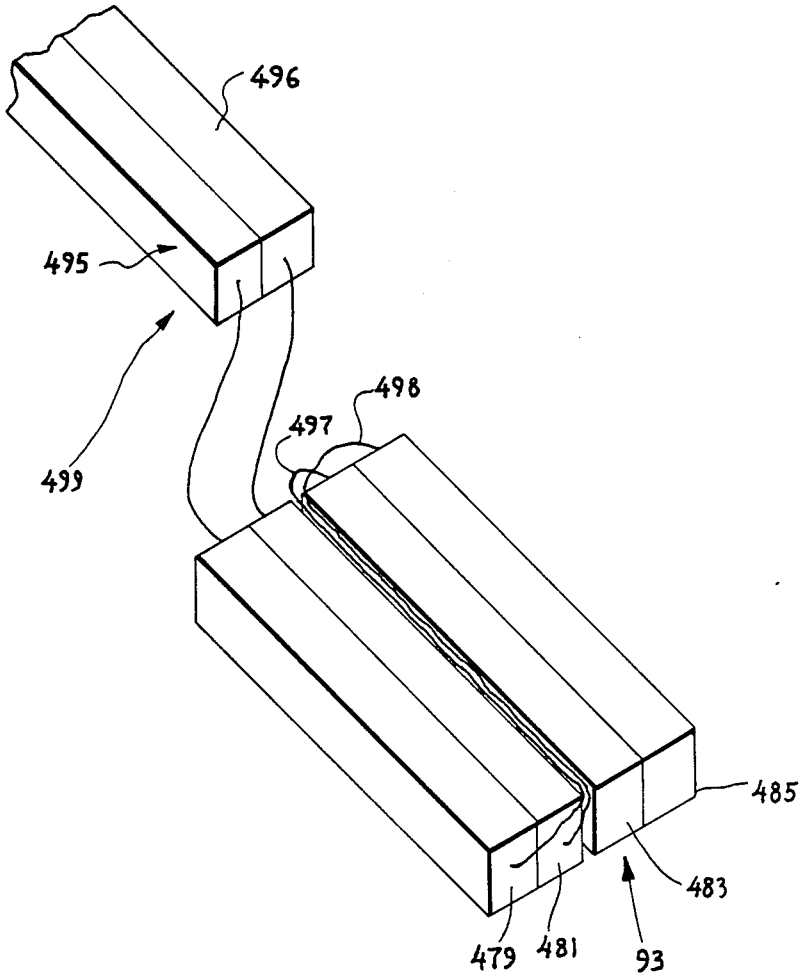

In addition to the single-end yarn wads described herein, several individual yarn lengths could be compacted simultaneously by the wad compacting apparatus of FIG. 2. Additionally, two or more yarn wads could be separately formed and routed side-by-side into a layer forming apparatus similar to that of FIG. 3 wherein side-by-side wads would be segmented together to form a layer having a wad relation as shown in FIG. 19. More particularly, the wad relation is a side-by-side unit 499 of two wads 495, 496 which are segmented into alternating extended and compacted side-by-side lengths. The compacted unit lengths are arranged one unit next to another to form a continuous layer 93 wherein the compacted lengths 479, 481, 483, 485 are joined within the layer by extended yarn lengths 497 and 498. The layers, such as 93, would be stacked one next to another with each layer connected to the next by side-by-side extended lengths to form a yarn package according to the invention.

Although the wad shape used to exemplify the invention has been shown to have a rectangular cross-section, any number of other cross-sections could also be usefully employed. Such cross-sections may be round, elliptical, triangular, etc., which can be separated into alternating extended and compacted lengths. The compacted lengths can be arranged one next to the other in a layer and the layers stacked one next to the other to form a package. Each layer would be connected one to the other by extended yarn lengths that serve to permit individual handling of the layers.

As is exemplified above, the wad packaging system utilizing individual layers of wads having connecting extended yarn lengths between layers is an extremely versatile system for forming a variety of wad packages. All packages retain the essential characteristics of individual layers connected by extended yarn segments. While many layers may comprise a package, it is also contemplated that a single layer comprised of compacted and extended length may be utilized as a package.

The process and apparatus of this invention can be used to package any natural of synthetic filamentary material that can be processed in this manner without breaking or fibrillating. Thermoplastic materials such as polyamides; e.g., poly(hexamethylene adipamide), poly(caproamide); cellulose esters; polyestres; e.g., polyethylene terephthalate; polyvinyls; polyacrylics; e.g., polyacrylonitrile; polyolefins; e.g.; polyethylene and polypropylene; and segmented polyurethanes are particularly suitable for producing the packages described herein and the preferred form of material is continuous filaments.

This apparatus and process are useful for textile deniers as well as the heavier carpet and industrial yarn sizes and are not restricted to any one particular type of filament cross-section.

We claim:

1. A yarn package comprising: alternating extended and axially compacted lengths of yarn wherein said compacted lengths of yarn are arranged in a common axial direction and said compact lengths and said extended lengths of yarn are arranged one next to the other to form a layer having opposed surfaces.

2. The yarn package of claim 1 wherein a plurality of said layers are stacked one next to the other so that opposed surfaces are in contact to form a shaped package and an extended length connecting one layer to the other.

3. The yarn package of claim 2, wherein adjacent layers are angularly oriented to each other.

4. A yarn package comprising: alternating extended and compacted lengths of yarn wherein said compacted lengths are in the form of layers having opposed surfaces with each surface having a minor axis, said layers being stacked one next to the other so that opposed surfaces are in contact, an extended length at least as long as said minor axis connecting one layer to another.

5. The yarn package of claim 4, wherein said layers are in the form of a spiral.

6. The yarn package of claim 4, wherein said layers are serpentine in form

7. The yarn packages of claims 1, 2, 3, 4, 5, or 6 wherein each layer is compressed.

8. The package of either claim 2 or 4 wherein the opposed surfaces of all layers are oriented in a common direction.

9. The yarn package of claim 4 wherein adjacent layers are stacked perpendicularly one to the other.

10. The yarn package of claim 6 wherein adjacent layers are stacked perpendicularly one to the other.

* * * * *

UNITED STATES PATENT AND TRADEMARK OFFICE

CERTIFICATE OF CORRECTION

PATENT NO. : 4,863,029

DATED : September 5, 1989

INVENTOR(S) : Joseph E. Koskol

It is certified that error appears in the above-identified patent and that said Letters Patent is hereby corrected as shown below:

On the title page inventor should read

--(75) Inventor: Joseph E. Koskol--.

Signed and Sealed this

Twenty-third Day of October, 1990

*Attest:*

HARRY F. MANBECK, JR.

*Attesting Officer*

*Commissioner of Patents and Trademarks*